US009222246B2

(12) United States Patent
VanAssche et al.

(10) Patent No.: US 9,222,246 B2
(45) Date of Patent: Dec. 29, 2015

(54) WASTE DISPOSAL WITH ENHANCED WATER MANAGEMENT FEATURES

(71) Applicant: General Electric Company, Schenectady, NY (US)

(72) Inventors: Raymond James VanAssche, Louisville, KY (US); Joseph Emil Gormley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 263 days.

(21) Appl. No.: 14/064,238

(22) Filed: Oct. 28, 2013

(65) Prior Publication Data

US 2015/0115080 A1 Apr. 30, 2015

(51) Int. Cl.

*B02C 23/36* (2006.01)
*E03C 1/266* (2006.01)
*B02C 23/00* (2006.01)

(52) U.S. Cl.

CPC ..... *E03C 1/2665* (2013.01); *B02C 23/00* (2013.01); *B02C 2201/06* (2013.01); *B02C 2201/063* (2013.01)

(58) Field of Classification Search

CPC ..... B02C 2201/06; B02C 2201/063; B02C 23/00; E03C 1/2665
USPC ..... 241/46.013, 46.014
See application file for complete search history.

(56) References Cited

U.S. PATENT DOCUMENTS 2,225,171 A 12/1940 Hammes
2,428,420 A 10/1947 Green
2,824,702 A 2/1958 Lee
2,832,546 A 4/1958 Sprague
2,909,333 A 10/1959 Shewmon et al.
2,949,246 A 8/1960 Hyde
4,227,655 A 10/1980 Williams
4,767,069 A 8/1988 Kim
6,007,006 A * 12/1999 Engel ..... E03C 1/2665 241/46.014
6,051,942 A 4/2000 French
6,096,546 A 8/2000 Raskin
6,481,652 B2 11/2002 Strutz et al.
6,648,252 B2 11/2003 Strutz
6,772,968 B2 * 8/2004 Jara-Almonte ..... E03C 1/2665 241/46.013
6,854,673 B2 2/2005 Strutz et al.
7,264,188 B2 9/2007 Anderson et al.
7,331,539 B2 * 2/2008 Jara-Almonte ..... E03C 1/2665 241/46.014
7,578,460 B2 * 8/2009 Berger ..... E03C 1/2665 241/46.014
7,584,914 B2 9/2009 Nishikawa et al.
7,866,583 B2 1/2011 Jara-Almonte (Continued)

FOREIGN PATENT DOCUMENTS

CN 202052753 U 11/2011
GB 2212576 A 7/1989

*Primary Examiner* — Faye Francis
(74) *Attorney, Agent, or Firm* — Dority & Manning, P.A.

(57) ABSTRACT

In one aspect, a waste disposal for processing waste may generally include a housing and a motor disposed within the housing. The housing may define an inner sidewall surface extending around an inner perimeter of the housing and a discharge outlet. The motor may include a stator and a rotor at least partially surrounding the stator. The rotor may include a sidewall defining an outer surface. The motor may be disposed within the housing such that an annular gap is defined between the inner sidewall surface of the housing and the outer surface of the sidewall. When the rotor is rotated relative to the stator, water may be drawn through the annular gap towards the discharge outlet.

20 Claims, 18 Drawing Sheets

(56) References Cited

U.S. PATENT DOCUMENTS

| | | | | |
|---|---|---|---|---|
| 7,971,810 | B2 | 7/2011 | Hirsch et al. | |
| 8,087,600 | B2 * | 1/2012 | Pan | E03C 1/2665 241/46.014 |
| 8,220,731 | B2 * | 7/2012 | Berger | E03C 1/266 241/46.013 |
| 8,267,339 | B2 | 9/2012 | Park et al. | |
| 8,500,050 | B2 * | 8/2013 | Ryder | B02C 18/0092 241/46.013 |
| 8,579,218 | B2 * | 11/2013 | Hammer | F16C 35/02 241/101.2 |
| 8,985,489 | B2 * | 3/2015 | Jara-Almonte | E03C 1/2665 241/46.014 |
| 2007/0075169 | A1 | 4/2007 | Pan et al. | |
| 2008/0302891 | A1 * | 12/2008 | Anderson | E03C 1/2665 241/46.014 |
| 2013/0015277 | A1 | 1/2013 | Hofmeister et al. | |
| 2013/0175375 | A1 * | 7/2013 | Jara-Almonte | E03C 1/2665 241/46.014 |

* cited by examiner

WASTE DISPOSAL WITH ENHANCED WATER MANAGEMENT FEATURES

FIELD OF THE INVENTION

The present subject matter relates generally to waste disposals for processing waste and, more particularly, to a waste disposal having enhanced water management features, such as pump-like features for directing water and processed waste towards an outlet of the disposal.

BACKGROUND OF THE INVENTION

Waste disposal units are typically used to process solid waste, such as food waste, garbage and/or other waste, into particulates small enough to pass through associated drain plumbing. A conventional waste disposal is configured to be mounted onto a sink drain extending downward from a corresponding sink such that water/waste discharged from the sink may be directed into the disposal. The water/waste is typically directed into a grind chamber defined above a cutting or grinding mechanism of the disposal. The grinding mechanism is coupled to a shaft of a corresponding motor to allow the grinding mechanism to be rotated at high speeds. As the grinding mechanism is rotated by the motor, the waste contained within the grind chamber is ground, shredded, cut and/or otherwise processed into small particulates. The water and processed waste may then be discharged from the disposal and transmitted through the associated plumbing.

Various waste disposal units are commercially available in the market today. While these disposal units typically provide a means for processing solid waste, the units often suffer from one or more significant drawbacks. For example, many conventional disposal units have elongated profiles or extended heights, typically due to the configuration of the motor and/or the connection of the motor to the grinding mechanism. As a result, such disposal units may often occupy a significant portion of the available storage under a sink. In addition, conventional disposal units often lack accurate control over and/or proper feedback related to one or more operational parameters of the motor (e.g., speed and/or torque), which can impact the overall performance of the disposal (e.g., in relation to noise generated, jamming/stalling, overheating, etc.) and can also impact the safety of the disposal's operation.

Moreover, conventional disposal units often have issues with waste becoming stuck on/in the grinding mechanism, within the grind chamber or at any other location within the disposal. For example, waste may often stick to the center of the grinding mechanism or become lodged within a corner of crevice of the grind chamber. If the waste remains stuck within the disposal for an elongated period of time, particularly for food waste, the disposal may emit an undesirable odor. Such issues are often due to the configuration and/or shape of the grinding mechanism and/or the grind chamber and/or due to a lack of proper water flow through the disposal. For example, an insufficient water flow may prevent the disposal unit from being capable of cleaning the grind chamber and other passages of the disposal. In addition, an insufficient water flow may also lead to a significant reduction in discharge rate of water and processed waste from the disposal.

Further, conventional disposal units are often difficult to install onto a sink drain. Specifically, most disposal units require that the installer support the weight of the disposal while the unit is simultaneously rotated onto a mount coupled to the sink drain. Given the limited space and location of the disposal units under the sink, such an installation process can be quite challenging and time consuming.

Accordingly, an improved waste disposal system that addresses one or more of the drawbacks or issues indicated above would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a waste disposal for processing waste. The waste disposal may generally include a housing and a motor disposed within the housing. The housing may define an inner sidewall surface extending around an inner perimeter of the housing and a discharge outlet. The motor may include a stator and a rotor at least partially surrounding the stator. The rotor may include a sidewall defining an outer surface. The motor may be disposed within the housing such that an annular gap is defined between the inner sidewall surface of the housing and the outer surface of the sidewall. When the rotor is rotated relative to the stator, water may be drawn through the annular gap towards the discharge outlet.

In another aspect, the present subject matter is directed to a waste disposal for processing waste. The waste disposal may generally include a housing and a motor disposed within the housing. The housing may define a bottom surface and a discharge outlet. The motor may include a stator and a rotor at least partially surrounding the stator. The rotor may include a sidewall and a bottom wall extending radially inwardly from the sidewall. The bottom wall may define a lower surface extending adjacent to the bottom surface of the housing such that a gap is defined between the lower surface and the bottom surface. In addition, the waste disposal may include a plurality of ribs formed along the bottom wall of the rotor. The ribs may be configured to push water contained within the gap radially outwardly along the bottom surface of the housing towards the discharge outlet when the rotor is rotated relative to the stator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
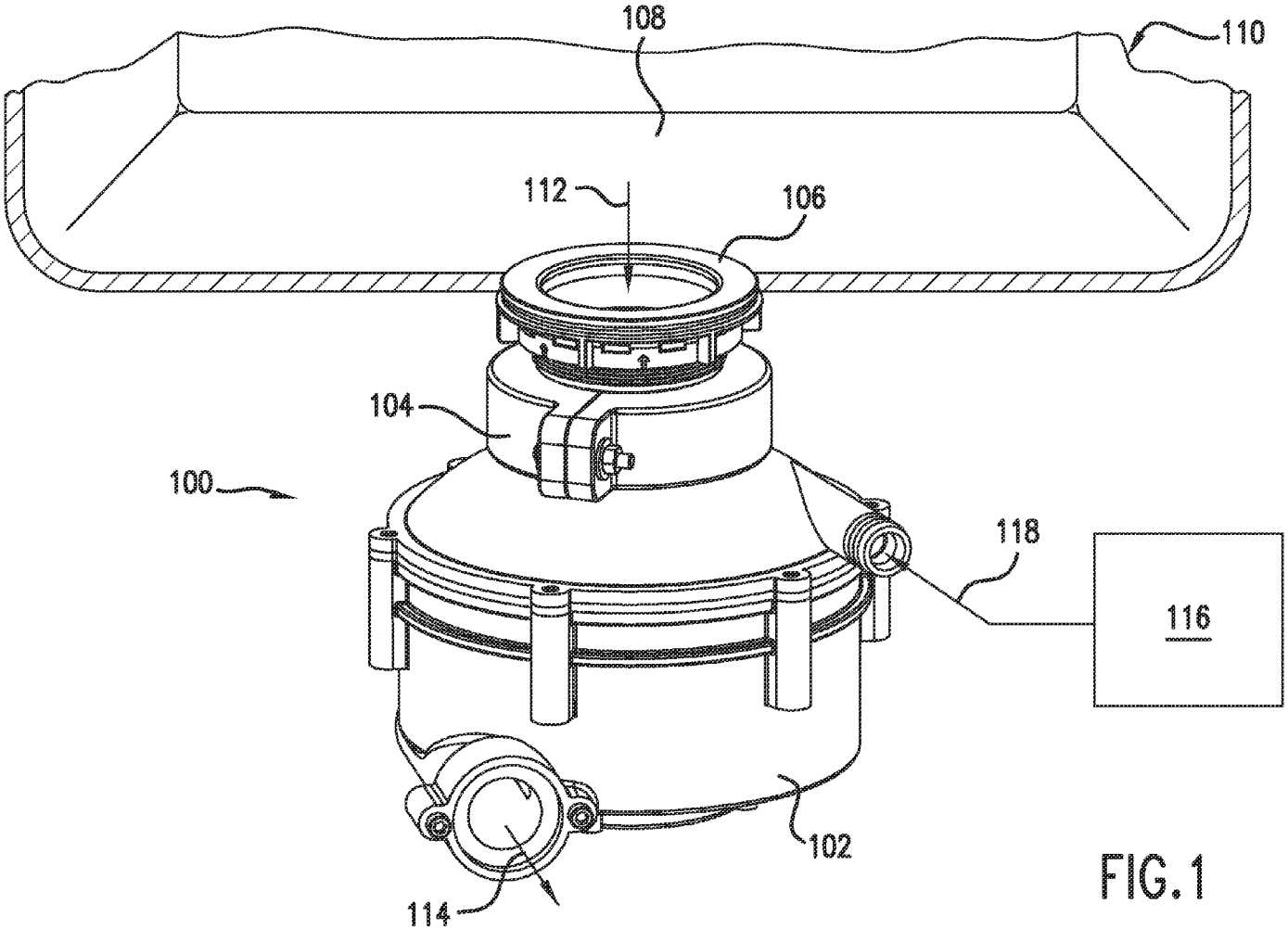
FIG. 1 illustrates a perspective view of one embodiment of a waste disposal system in accordance with aspects of the present subject matter, particularly illustrating a waste disposal of the system mounted onto a sink drain of a corresponding sink via a mounting assembly of the system.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to an improved waste disposal system for processing waste, such as food waste, garbage and/or other waste. In several embodiments, the system may include a waste disposal and a mounting assembly for mounting the waste disposal onto a sink drain of a corresponding sink. The waste disposal may generally include an outer housing and a motor disposed within the housing. In addition, the waste disposal may include a cutter plate configured to be rotated by the motor directly below a grind chamber defined within the housing and a stationary cutter ring disposed around the outer perimeter of the grind chamber. As water and waste are directed into the housing and fall onto the rotating cutter plate, the water/waste may be directly radially outwardly towards the stationary cutter ring. The waste may then be ground, shredded, cut and/or otherwise processed into small particulates as a cutter lug of the cutter plate pushes the waste into and/or against the stationary cutter ring. The water and processed waste may then be discharged from the waste disposal via an outlet defined in the housing.

In accordance with one aspect of present subject matter, the motor of the waste disposal may have an external rotor configuration. Specifically, in several embodiments, the motor may include a stator and a rotor that at least partially surrounds the outer perimeter of the stator. For example, as will be described below, the rotor may be configured to define a rotor cavity that at least partially encases the stator. Such an external rotor configuration may generally allow for the cutter plate of the disposal to be coupled to the motor for rotation therewith via a shaftless connection. For instance, in several embodiments the cutter plate may be directly coupled to the outer rotor (e.g., using suitable mechanical fasteners) or the cutter plate may be formed integrally with the outer rotor.

By configuring the motor to have an external rotor configuration as well as coupling the cutter plate to the motor via a shaftless connection, the overall height or profile of the entire waste disposal unit may be reduced significantly. As a result, the storage space provided under the associated sink may be increased substantially.

Additionally, in several embodiments of the present subject matter, the motor may be communicatively coupled to a controller (e.g., a microcontroller) configured to electronically control one or more operational parameters of the motor. For example, the controller may be configured to precisely control the speed and/or torque profile for the motor. Such precise control of the speed and/or torque may allow for enhanced operation of the motor. For instance, the controller may be configured to initially operate the motor at a reduced speed upon start-up and then ramp-up the speed over time to a full operational speed. As a result, the noise generated at start-up of the disposal may be reduced significantly. Additionally, the speed/torque control provided by the controller may also be utilized to reduce the overall noise generated during normal operation of the disposal.

In several embodiments, the controller may also be configured to receive various feedback signals (e.g., sensor signals) that may be utilized to further enhance operation of the motor. For instance, speed feedback signals may be utilized by the controller to provide for accurate control of the motor speed while rotor position feedback signals may assist the controller in accurately commutating the motor. Similarly, temperature feedback signals may be utilized by the controller to prevent overheating of the motor. Moreover, jam feedback signals may be used by the controller to detect a jammed motor condition (e.g., when the motor is stalled or jammed). Upon the detection of a jammed motor condition, the controller may be configured to automatically initiate corrective actions for unjamming the motor, thereby improving the operational safety of the waste disposal.

Moreover, in accordance with another aspect of the present subject matter, the cutter plate of the waste disposal may include various surface features along its upper surface designed to enhance the overall operation of the disposal. Specifically, in several embodiments, the upper surface may be designed in a manner that improves the effectiveness of the cutter plate in directing water and waste radially outwardly towards the outer perimeter of the plate (e.g., towards the stationary cutter ring). For example, the cutter plate may be designed with an offset high point along its upper surface (e.g., at a location near its outer peripheral surface), with at least a portion of the upper surface being angled or sloped downward from the high point as the surface extends radially outwardly towards the stationary cutter ring. In one embodiment, the high point of the upper surface may simply be offset from the rotational axis of the motor. As a result, the high point may positioned away from the location on the cutter plate at which the rotational speed is zero, thereby preventing waste from sticking or being help-up at this zero-speed location. In another embodiment, the high point may be offset from the rotational axis by a given distance or radius such that the high point is located on the upper surface outside the open area defined directly below the primary inlet of the disposal. In such an embodiment, the entire portion of the upper surface defined directly below the open area may be sloped or angled, thereby providing a means for directing water and waste falling onto the cutter plate radially outwardly towards the outer perimeter of the plate.

Additionally, in several embodiments, one or more fins may also be formed along the upper surface of the cutter plate. The fins may generally correspond to axial projections extending lengthwise along the sloped portion of the upper surface. Thus, as the cutter plate is rotated, the ribs may be configured to push waste radially outwardly along the plate. In addition, the ribs may also serve as an agitating means for agitating the water flowing along the cutter plate, which may assist in cleaning the grind chamber of the disposal.

By providing surface features that are configured to direct water and waste radially outwardly along the cutter plate, the cutter lug associated with the cutter plate may be positioned at the outer edge of the plate. As such, the cutter lug may be located further away from the area in which a user may reach into the disposal via the primary inlet. Such positioning of the cutter lug along the outer edge of the cutter plate may also allow for a lug guard to be formed on the plate at a location radially inwardly from the lug. Accordingly, if a user has reached down into the disposal, the lug guard may serve as a means for restricting user access to the location of the cutter lug, which may prevent user injuries (e.g., due to cuts).

Additionally, in accordance with a further aspect of the present subject matter, an upper portion of the disposal housing may be configured such that the grind chamber is substantially dome-shaped. Specifically, in several embodiments, an inner surface of the upper portion may define a generally curved profile along a converging section of the housing such that the grind chamber forms a dome-like shape. Such a dome-shaped grind chamber may allow for the area of the chamber to be maximized without creating sharp edges or crevices within which waste may become stuck. For instance, most conventional waste disposals include a cylindrically shaped housing defining a cylindrically shaped grind chamber. As such, a circumferentially extending corner is defined around the top of the grind chamber along which waste may get stuck. In contrast, the dome-shaped grind chamber disclosed herein may allow for the increased chamber capacity provided by a cylindrical housing without creating an undesirable corner. In addition, the dome-like shape of the chamber may also allow for water to flow partially upward along the inner surface of the upper portion of the housing, thereby assisting in cleaning the grind chamber and enhancing water circulation within the disposal.

Moreover, in accordance with yet another aspect of the present subject matter, the disclosed waste disposal may also include one or more water management features configured to enhance water flow through the disposal. For instance, in several embodiments, one or more outwardly projecting deflector ribs may be formed along the dome-shaped inner surface of the housing that are configured to deflect the flow water back down onto the cutter plate. Specifically, as water is directed radially outwardly towards the outer edge of the cutter plate and subsequently begins to flow upward along the inner surface of the housing, the water may contact the edges of the ribs and fall back onto the cutter plate. As a result, water may be prevented from flowing upward along the housing to the point at which some of the water may splash out of the inlet of the disposal.

Additionally, in several embodiments, an annular gap may be defined between an outer wall of the rotor and an inner wall of the housing that serves as a pump-like feature for pumping water and processed waste downward along the outside of the rotor towards the discharge outlet of the disposal. Specifically, by carefully selecting the width of the annular gap, an increase in surface tension between the adjacent walls may be achieved that, together with the high speed rotation of the rotor, allows for the rotor to function similar to a bladeless water turbine. The resulting spiraling, downward flow of water along the outside of the rotor may produce a pumping action that aids in directing the water and processed waste towards the discharge outlet.

Moreover, in several embodiments, a bottom wall of the motor may define a plurality of axially projecting ribs configured to extend radially between a central portion of the motor and the outer sidewall of the rotor. The ribs may generally be configured to serve as impellers or blades for pushing any water and/or processed waste that may have collected between the housing and the bottom wall of the motor radially outwardly towards the discharge outlet of the disposal.

As indicated above, the disclosed system may also include a mounting assembly for mounting the waste disposal to a sink drain. As opposed to conventional mounting systems that require the installer to support the weight of the disposal while simultaneously rotating the disposal onto a corresponding portion of the sink drain, the disclosed mounting assembly may allow for the disposal to be installed onto the sink drain by simply pushing the disposal upwards towards the sink drain. Specifically, in several embodiments, the mounting assembly may include one or more inner mounting brackets configured to be initially installed around the top of the disposal housing. The inner mounting bracket(s) may include radially projecting teeth that are configured to snap over and engage a corresponding flange formed on the sink drain as the disposal is pushed upward towards the drain. Specifically, the teeth may be configured to flex or move radially outwardly as the teeth are pushed upward against the drain flange. When the disposal is pushed sufficiently upward relative to the drain such that the teeth clear the drain flange, the teeth may snap back radially inwardly and overlap the drain flange. At this point, the weight of the disposal may be fully supported by the drain. Suitable outer mounting brackets may then be installed over the inner mounting bracket(s) to complete the mounting process.

It should be appreciated that the various waste disposal components and features disclosed by the present subject matter will generally be described herein as being included in combination within a common waste disposal system. However, one of ordinary skill in the art, using the disclosures provided herein, should readily appreciate that each component and/or feature described herein and/or any combination of such components and features may be separately included within any suitable waste disposal system to improve the overall performance of such system.

Referring now to the drawings, FIG. 1 illustrates a perspective view of one embodiment of a waste disposal system 100 in accordance with aspects of the present subject matter. As shown, the waste disposal system 100 generally includes a waste disposal 102 and a mounting assembly 104 configured for mounting the disposal 102 to a sink drain 106 extending from the bottom of a sink basin 108 of a corresponding sink 110. As is generally understood, while the sink 110 is being used, water and waste (e.g., food waste and other solid waste) may collect within the sink basin 108 and may be subsequently discharged therefrom via the drain 106. The water and waste flowing through the drain 106 may then be directed into the waste disposal 102 (as indicated by arrow 112), wherein the waste may be processed into fine particulates. The water and processed waste may then be discharged from the waste disposal 102 (as indicated by arrow 114) into a suitable flow conduit or discharge line (not shown) of the associated plumbing.

Additionally, as shown in FIG. 1, in several embodiments, the waste disposal 102 may also be configured to receive water and/or waste discharged from a dishwasher 116 in fluid communication with the disposal 102 (as indicated by arrow 118). In such embodiments, the waste received from the dishwasher 116 may similarly be processed into fine particulates and subsequently discharged from the waste disposal 102 (as indicated by arrow 114).

Figure 2:
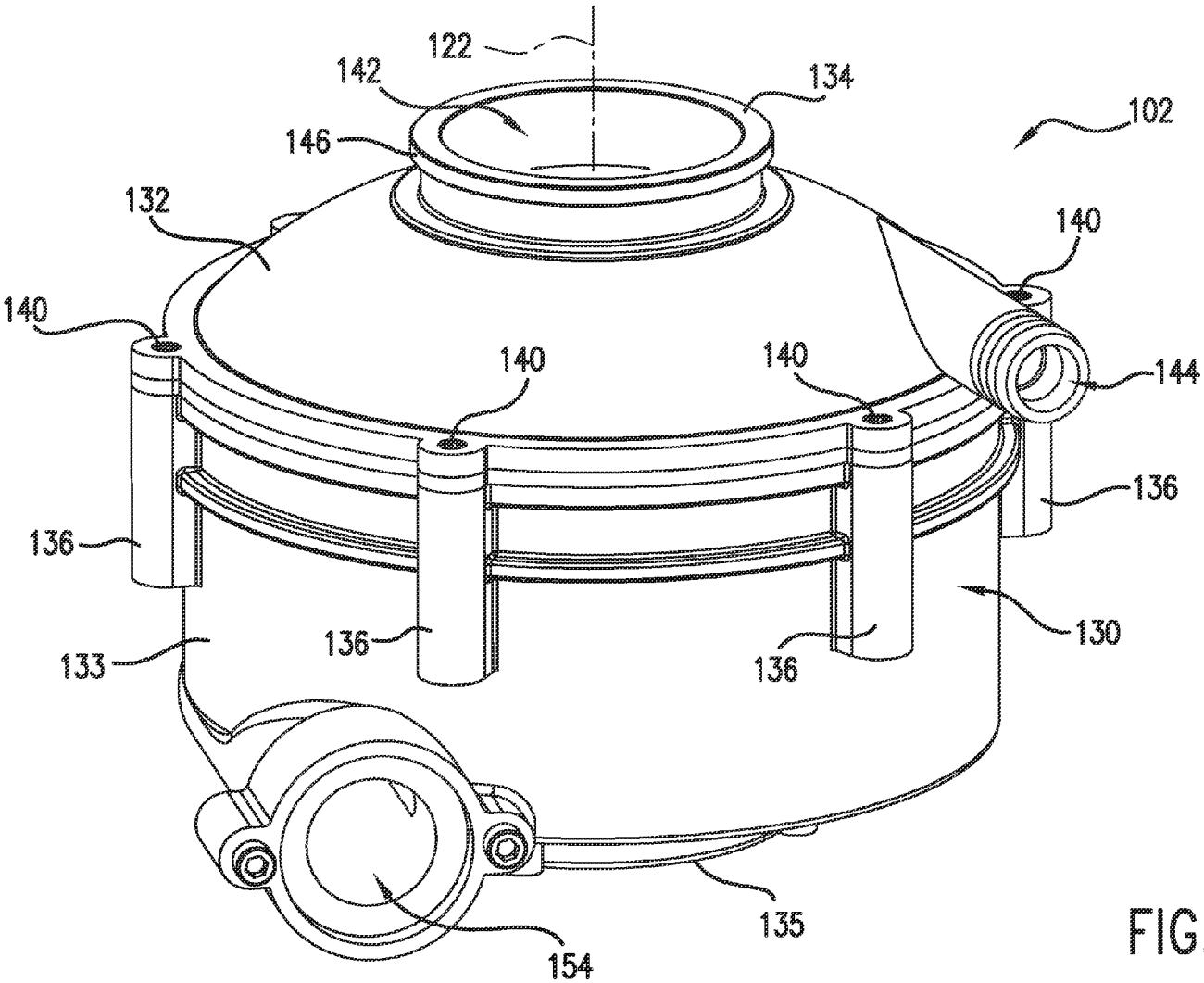
FIG. 2 illustrates a perspective view of the waste disposal shown in FIG. 1.
Figure 3:
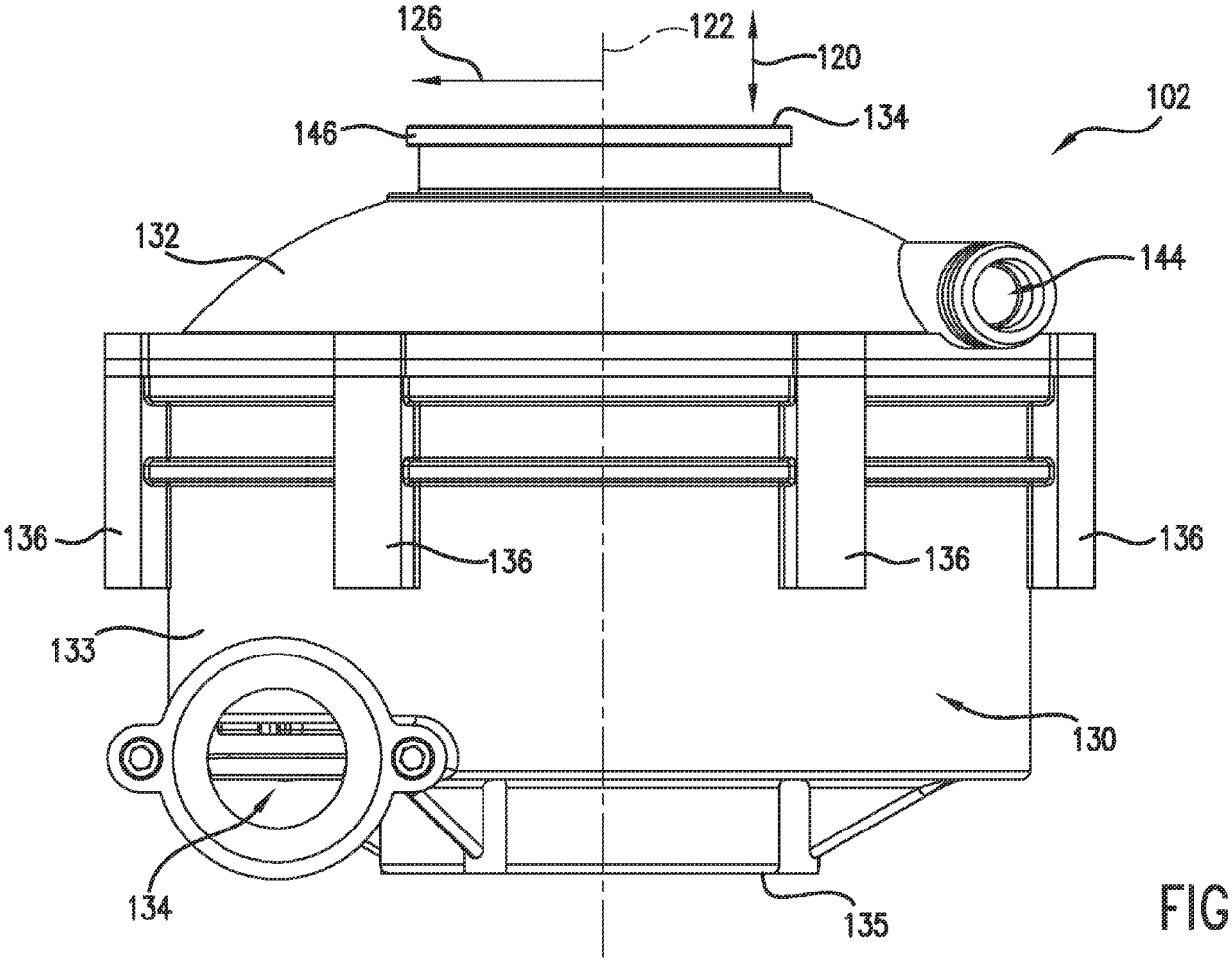
FIG. 3 illustrates a side view of the waste disposal shown in FIG. 2.
Figure 4:
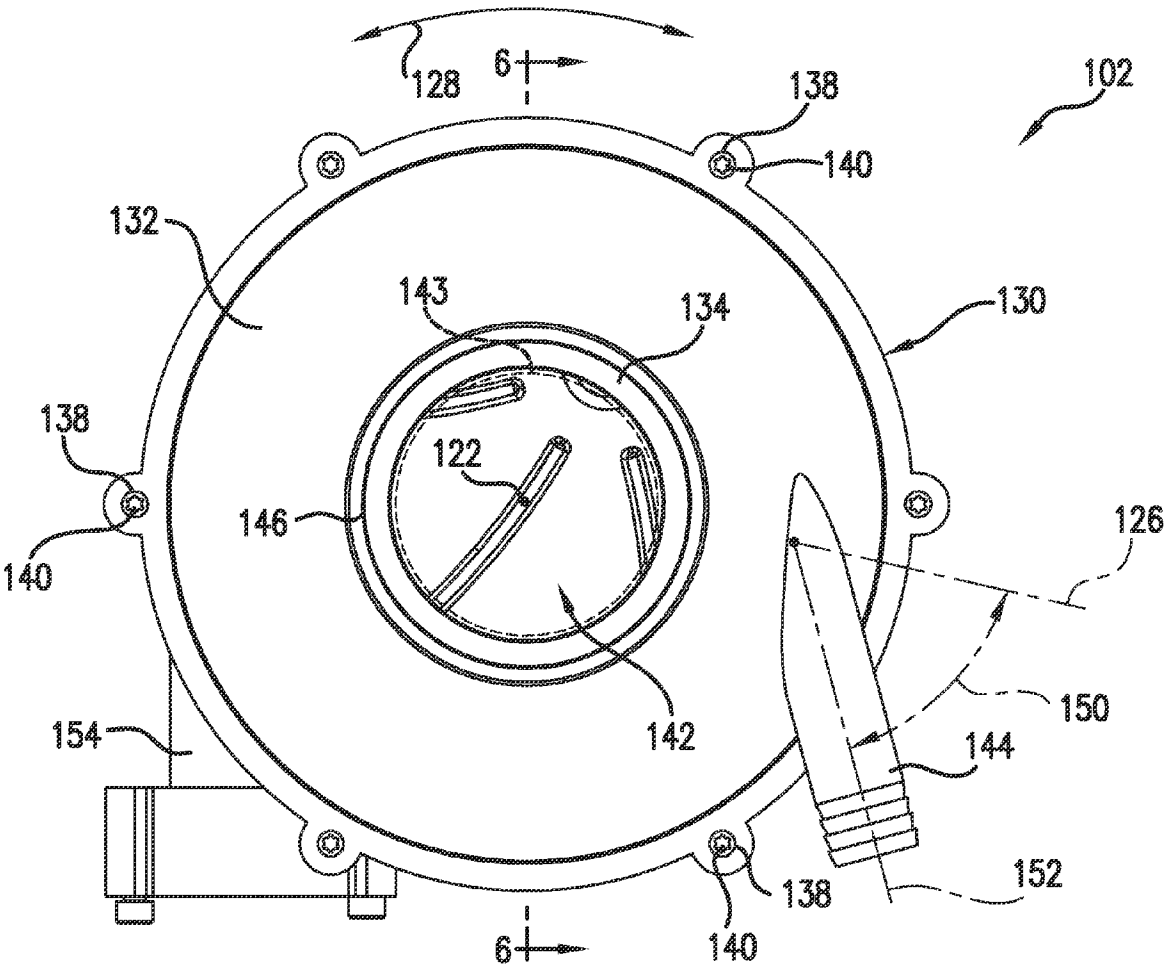
FIG. 4 illustrates a top view of the waste disposal shown in FIG. 2.
Figure 5:
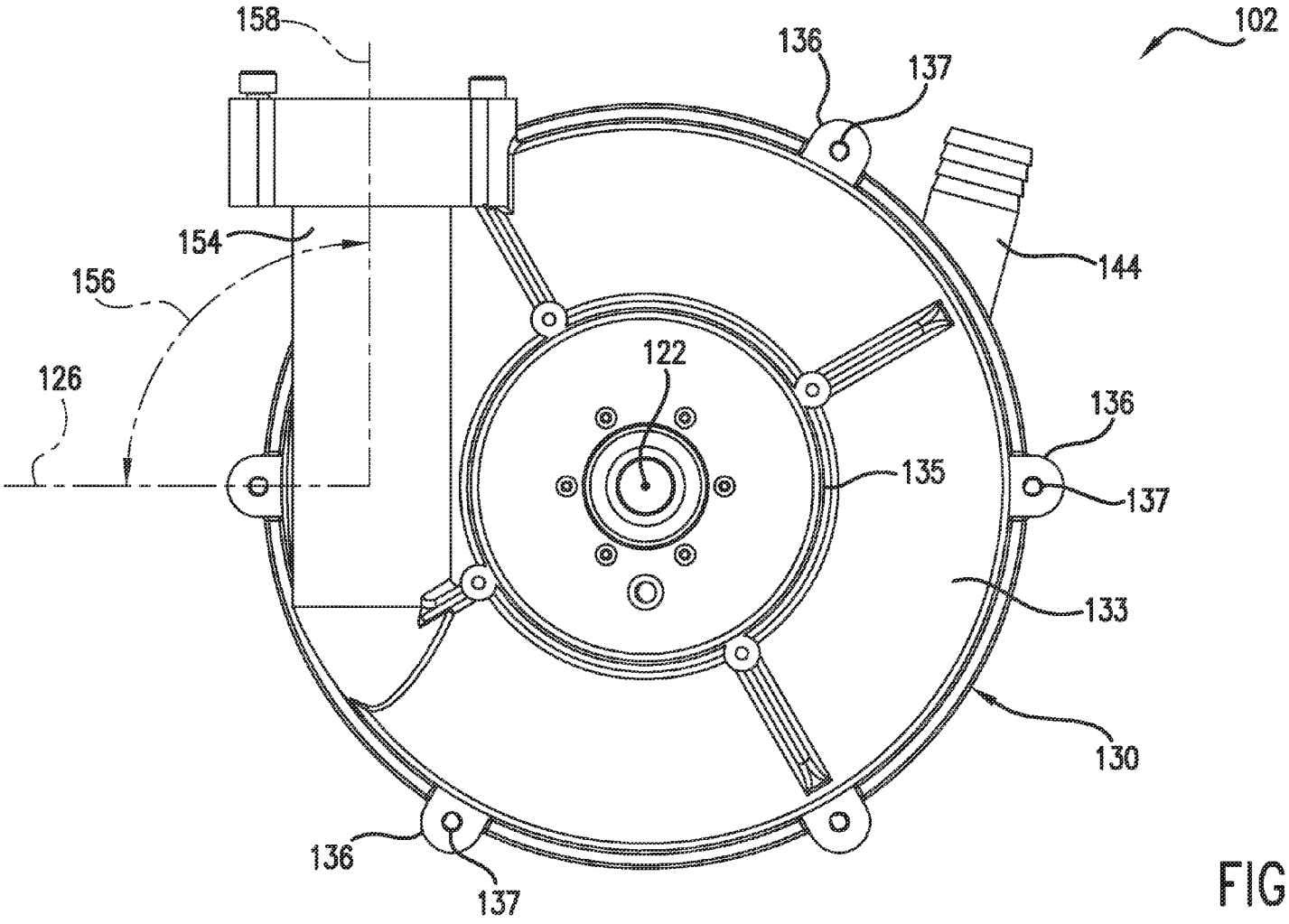
FIG. 5 illustrates a bottom view of the waste disposal shown in FIG. 2.

Referring now to FIGS. 2-5, several views of the waste disposal 102 of the system 100 shown in FIG. 1 are illustrated in accordance with aspects of the present subject matter. Specifically, FIG. 2 illustrates a perspective view of the waste disposal 102 and FIG. 3 illustrates a side view of the waste disposal 102. Additionally, FIGS. 4 and 5 illustrate respective top and bottom views of the waste disposal 102.

For purposes of reference, it should be appreciated that the axial direction (indicated by arrow 120 in FIG. 3) is generally defined as extending parallel to a rotational axis 122 of a motor 124 (FIG. 6) of the disposal 102. Similarly, the radial direction (indicated by arrow 126 in FIG. 3) is defined as extending outwardly from the rotational axis 122 of the motor 124 in a radial direction perpendicular to the axial direction 120. Additionally, the circumferential direction (indicated by arrow 128 in FIG. 4) is defined as extending around a circle of any radius centered at the rotational axis 122 of the motor 124.

As particularly shown in FIGS. 2-5, the waste disposal 102 generally includes a housing 130 configured to form an outer casing or enclosure for the various other components of the disposal 102. In general, the housing 130 may have any suitable configuration that allows it to function as casing or enclosure for the disposal components. For example, in several embodiments, the housing 130 may include a substantially dome-shaped upper housing portion 132 and a substantially cylindrically-shaped lower housing portion 133 extending axially between a top 134 and a bottom 135 of the housing 130. As shown in the illustrated embodiment, the upper and lower housing portions 132, 133 may correspond to separate components of the housing 130 and, thus, may be configured to be separately attached to one another using any suitable attachment means (e.g., mechanical fasteners, glue, welding, etc.). For instance, in one embodiment, the lower housing portion 133 may include one or more outwardly extending projections 136 defining openings 137 (FIG. 5) configured to be aligned with corresponding openings 138 (FIG. 4) defined in the upper housing portion 132. In such an embodiment, suitable mechanical fasteners 140 (e.g., screws, bolts, pins, etc.) may be inserted through the aligned openings to couple the upper housing portion 132 to the lower housing portion 133. Alternatively, the upper and lower housing portions 132, 133 may be formed integrally as a single housing component. In a further embodiment, the upper housing portion 132 and/or the lower housing portion 133 may be formed from two or more housing components coupled together.

In addition, the housing 130 may include one or more inlets 142, 144 for receiving discharged water and/or waste. For example, a primary inlet 142 may be defined at the top 134 of the housing 130 for receiving water/waste discharged from the sink 110. Specifically, as shown in FIGS. 2 and 4, the primary inlet 142 may correspond to an opening defined axially through the top of the upper housing position 142 so as to be centered or substantially centered about the rotational axis 122 of the motor 124. The opening formed by the primary inlet 142 may generally define an open area (indicated by dashed circle 143 (FIG. 4)) that is bounded by the outer circumference of the inlet 142. As will be described below, a mounting lip or flange 146 may be formed at the top 134 of the housing 130 around the primary inlet 142 for coupling the waste disposal 110 to the sink drain 106 (FIG. 1) via the disclosed mounting assembly 104. Accordingly, water and waste discharged from the sink 110 may be directed through the drain 106 and into the disposal 102 via the primary inlet 142.

As indicated above, a secondary inlet 144 may also be defined in the housing 130 for receiving water and/or waste discharged from a dishwasher (e.g., dishwasher 116 of FIG. 1) in fluid communication with the disposal 102. Specifically, as shown in the illustrated embodiment, the secondary inlet 144 may be defined in the upper housing portion 132 at a location axially below the primary inlet 142. In several embodiments, the secondary inlet 144 may be oriented relative the housing 130 such that water/waste flowing through the inlet 144 are introduced into the disposal 102 at a non-radial flow angle 150. For example, as shown in FIG. 4, the flow of water/waste through the inlet (indicated by dashed line 152) may be angled relative to the radial direction (indicated by dashed line 126). In one embodiment, the non-radial flow angle 150 defined by the secondary inlet 144 may be selected so that the flow of water/waste is introduced into the housing 130 tangential to the rotational axis 122 of the motor 124, thereby creating a downward, spiraling flowpath along the inner surface of the housing portion 132. Such a spiraling flowpath may provide a means for circulating water throughout the housing 130 and, thus, may assist in cleaning the disposal 102. In addition, the angled orientation of the secondary inlet 114 may also serve to prevent water from being discharged from the housing 130 via the inlet 144. However, it should be appreciated that, in other embodiments, the secondary inlet 144 may have any other suitable orientation relative to the housing 130, including a primarily radial orientation.

Moreover, one or more outlets 154 may also be defined in the housing 130 for discharging water and waste from the disposal 102. For example, as shown in the illustrated embodiment, a discharge outlet 154 may be defined at and/or adjacent to the bottom 135 of the housing 130 (e.g., at a location along the lower housing portion 133). In several embodiments, the discharge outlet 154 may be oriented relative to the housing 130 such that water and waste are discharged from the disposal 102 at a non-radial flow angle 156. For example, as shown in FIG. 5, the flow of water/waste through the outlet 154 (indicated by dashed line 158) may be angled relative to the radial direction (indicated by dashed line 126). In one embodiment, the non-radial flow angle 156 defined by the discharge outlet 154 may be selected so that the flow of water/waste is discharged from the housing 130 tangential to the rotational axis 122 of the motor 124. For instance, as will be described below, one or more pump-like features of the waste disposal 102 may be configured to create a downward, spiraling flow path of water and processed waste along the interior of the housing 130 in the direction of the discharge outlet 154. Thus, the non-radial or tangential orientation of the outlet 154 may allow for the spiraling flow of water/waste to be effectively discharged from the disposal 102. However, in other embodiments, the discharge outlet 154 may have any other suitable orientation relative to the housing 130, including a primarily radial orientation.

Figure 6:
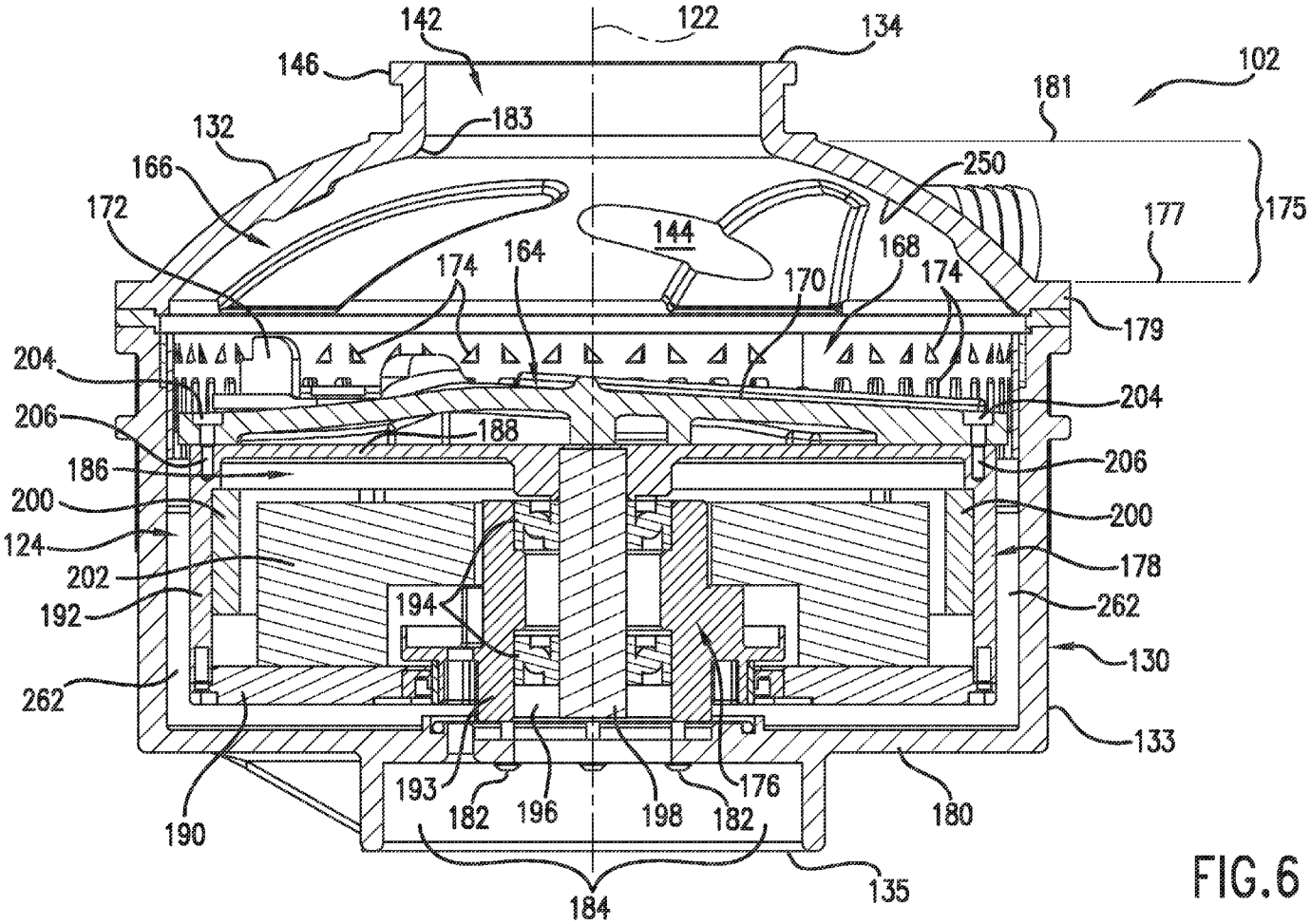
FIG. 6 illustrates a cross-sectional view of the waste disposal shown in FIGS. 2-5 taken about line 6-6 (FIG. 4)
Figure 7:
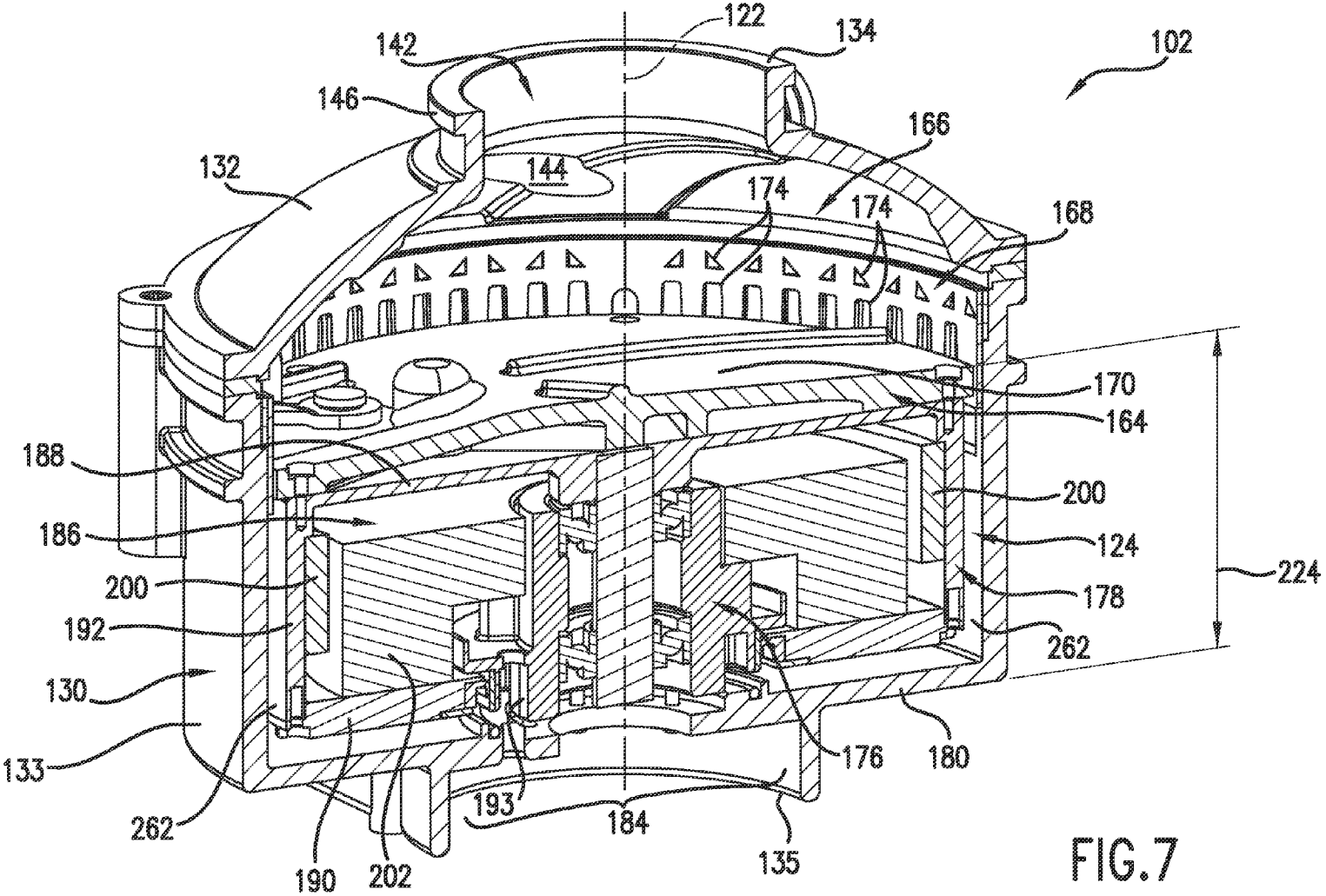
FIG. 7 illustrates a perspective view of the cross-section of the waste disposal shown in FIG. 6.

Referring now to FIGS. 6 and 7, interior views of the waste disposal 102 shown in FIGS. 2-5 are illustrated in accordance with aspects of the present subject matter. Specifically, FIG. 6 illustrates a cross-sectional view of the waste disposal 102 taken about line 6-6 (FIG. 4). Additionally, FIG. 7 illustrates a perspective view of the cross-section shown in FIG. 6.

As shown in FIGS. 6 and 7, the waste disposal 102 may include a motor 124 disposed within the housing 130. In general, the motor 124 may be configured to rotate a cutter plate 164 about its rotational axis 122 directly below a grind chamber 166 defined between the upper housing portion 132 and the cutter plate 164. As will be described below, the cutter plate 164 may be specifically designed so that water/waste entering the disposal 102 are directed radially outwardly along the plate 164 towards a stationary cutting ring 168 disposed around the inner perimeter of the housing 130 (i.e., the outer perimeter of the grind chamber 166). For example, the cutter plate 164 may define an upper surface 170 that is angled or sloped towards the inner perimeter of the housing 130 so that water/waste contacting a central portion of the plate 164 may be directed radially outwardly. In addition, the cutter plate 164 may include a cutter lug 172 (FIG. 6) coupled thereto for pushing waste flowing along the outer perimeter of the plate 164 into the adjacent cutter ring 168. The cutter ring 168 may, in turn, define a plurality of cutter openings 174 that serve to grind, shred, cut and/or otherwise process the waste.

Thus, during operation of the waste disposal 102, water/waste flowing into the grinding chamber 166 via the primary inlet 142 may be directed onto the cutter plate 164. Due to the rotation of the cutter plate 164 by the motor 124, the water/waste may be directed radially outwardly along the cutter plate 164 towards the stationary cutter ring 168. The waste flowing along the outer perimeter of the cutter plate 164 may then be pushed by the cutter lug 172 into and/or against the cutter openings 174 of the cutter ring 168 in order to process the waste into fine particulates. The processed waste may then be carried downwardly with the water flowing between the motor 124 and the housing 130 and subsequently discharged from the disposal via the discharge outlet 154.

As particularly shown in FIG. 6, in several embodiments, the upper housing portion 132 may define a converging section 175 extending axially between a first end 177 located at or adjacent to a base 179 of the upper housing portion 132 and a second end 181 located at or adjacent to a bottom end 183 of the primary inlet 142. This converging section 175 may generally be configured to define any suitable profile such that a radial dimension of the housing 130 (e.g., an inner diameter 185 (FIG. 13) of the upper housing portion 132) is generally reduced as the housing 130 extends axially between the first and second ends 177, 179 of the converging section 175. For example, in one embodiment, the upper housing portion 132 may define an angled profile along the converging section 175 (e.g. by defining angled walls between the first and second ends 177, 179 of the converging section 175). However, as indicated above, the upper housing portion 132 may, in several embodiments, be configured such that the grind chamber 166 is substantially dome-shaped. Thus, as shown in FIG. 6, in several embodiments, an inner surface 250 of the upper housing portion 132 may be configured to define a curved profile between the first and second ends 177, 179 of the converging section 175 such that the grind chamber 116 defines a dome-like shape along the converging section 175.

Additionally, as shown in FIGS. 6 and 7, in several embodiments, the motor 124 of the disclosed disposal 102 may have an outrunner or external rotor configuration. As such, the motor 124 may include a stator 176 and a rotor 178 extending around the outer circumference of the stator 176. For example, as shown in the illustrated embodiment, the stator 176 may be coupled to a bottom wall 180 of the housing 130 (e.g., via suitable mechanical fasteners 182) and may extend axially from the bottom wall 180 along a central portion 184 of the housing 130. Additionally, the rotor 178 may include one or more walls defining a rotor cavity 186 extending around the central portion 184 of the housing 130 so as to at least partially surround or encase the stator 176. For example, as shown in the illustrated embodiment, the rotor 178 may include a top wall 188, a bottom wall 190 extending generally parallel to the top wall 190 and a sidewall 192 extending axially between the top and bottom walls 188, 190. The top wall 188 may be configured to extend radially outwardly from the rotational axis 122 of the motor 124 at a location axially above the top of the stator 178 and may generally define the top of the rotor cavity 186. Similarly, as shown in FIGS. 6 and 7, the bottom wall 190 may be configured to extend radially outwardly from a bottom portion 193 of the stator 176 at a location adjacent to the bottom wall 180 of the housing 130 and may generally define the bottom of the rotor cavity 186. Additionally, the sidewall 192 may be configured to extend circumferentially around the stator 176 and may generally define the side of the rotor cavity 186. As such, when the rotor 178 is rotated, the sidewall 192 may rotate around the outer circumference or perimeter of the stator 176.

Moreover, as particularly shown in FIG. 6, the motor 124 may also include one or more bearings 194 disposed within a central passage 196 defined through the stator 176. The bearings 194 may be configured to rotationally support a rotor shaft 198 extending axially from the top wall 188 of the rotor 178 through the central passage 196. The rotor shaft 198 may, in turn, rotationally support the rotor 178 relative to the stator 176. It should be appreciated that, given the external rotor configuration of the motor 124, the rotational torque required to rotate the rotor 178 relative to the stator 176 is applied directly through the rotor 178 and not through the rotor 178 via the rotor shaft 198.

It should be appreciated that the motor 124 may generally correspond to any suitable type of motor that provides for an external rotor configuration. For example, as shown in the illustrated embodiment, the motor 124 is configured as a brushless direct-current electric motor (BLDC motor). As such, the motor 124 may include a plurality of magnets 200 coupled to and/or forming part of the sidewall 192 of the rotor 178 and a plurality of windings 202 wrapped around the stator 176. As will be described below with reference to FIG. 21, a suitable controller (e.g., a microcontroller) may be utilized to adjust the current phase supplied to the windings 202 in order to produce rotational torque that rotates the rotor 178 relative to the stator 176. This rotational torque is applied directly through the rotor 178, with the rotor shaft 198 simply providing rotational support for the rotor 178 along the rotational axis 122 of the motor 124. Alternatively, the motor 124 may correspond to any other suitable motor type that allows for an external rotor configuration, such as a switched reluctance motor, a synchronous reluctance motor or an induction motor.

It should also be appreciated that, in alternative embodiments, the rotor 178 need not define a rotor cavity 186 formed by the illustrated top, bottom and sidewalls 188, 190, 182. For example, in one embodiment, the rotor 178 may simply include a top wall 188 extending above the stator 176 and a sidewall 192 extending axially from the top wall 188 so as to extend circumferentially around the stator 176. In another embodiment, the rotor 178 may only include a top wall 188 extending radially outwardly from the rotational axis 122 at a location above the stator 176. In such an embodiment, instead of being driven by the radial magnetic flux generated between the rotor sidewall 192 and the stator 176, the rotor 178 may be driven by an axial magnetic flux generated between the top wall 188 and the stator 176 (e.g., by coupling the magnets 200 to the axially lower surface of the top wall 188).

Additionally, as shown in FIGS. 6 and 7, in several embodiments, the cutter plate 164 may be configured to be coupled to the motor 124 via a shaftless connection. As used herein, the term "shaftless connection" refers to a rotatable connection between the cutter plate 164 and the motor 124 that does not require the plate 164 to be directly coupled to a shaft of the motor 124. For example, in several embodiments, the cutter plate 164 may be directly coupled to the rotor 178. Specifically, as shown in FIGS. 6 and 7, the cutter plate 164 may be configured to be secured to the rotor 178 so that it extends along and/or forms part of the top wall 188 of the rotor 178. In such an embodiment, the cutter plate 164 may be secured to the rotor 178 using any suitable attachment means, such as mechanical fasteners, glue, welding, etc. For instance, as shown in FIG. 6, openings 204 defined in the cutter plate 164 may be configured to be aligned with corresponding openings 206 defined in the rotor 178 to allow suitable mechanical fasteners (e.g., bolts, screws, pins, etc.) to be inserted through the aligned openings 204, 206 in order to secure the cutter plate 164 to the rotor 178.

Figure 8:
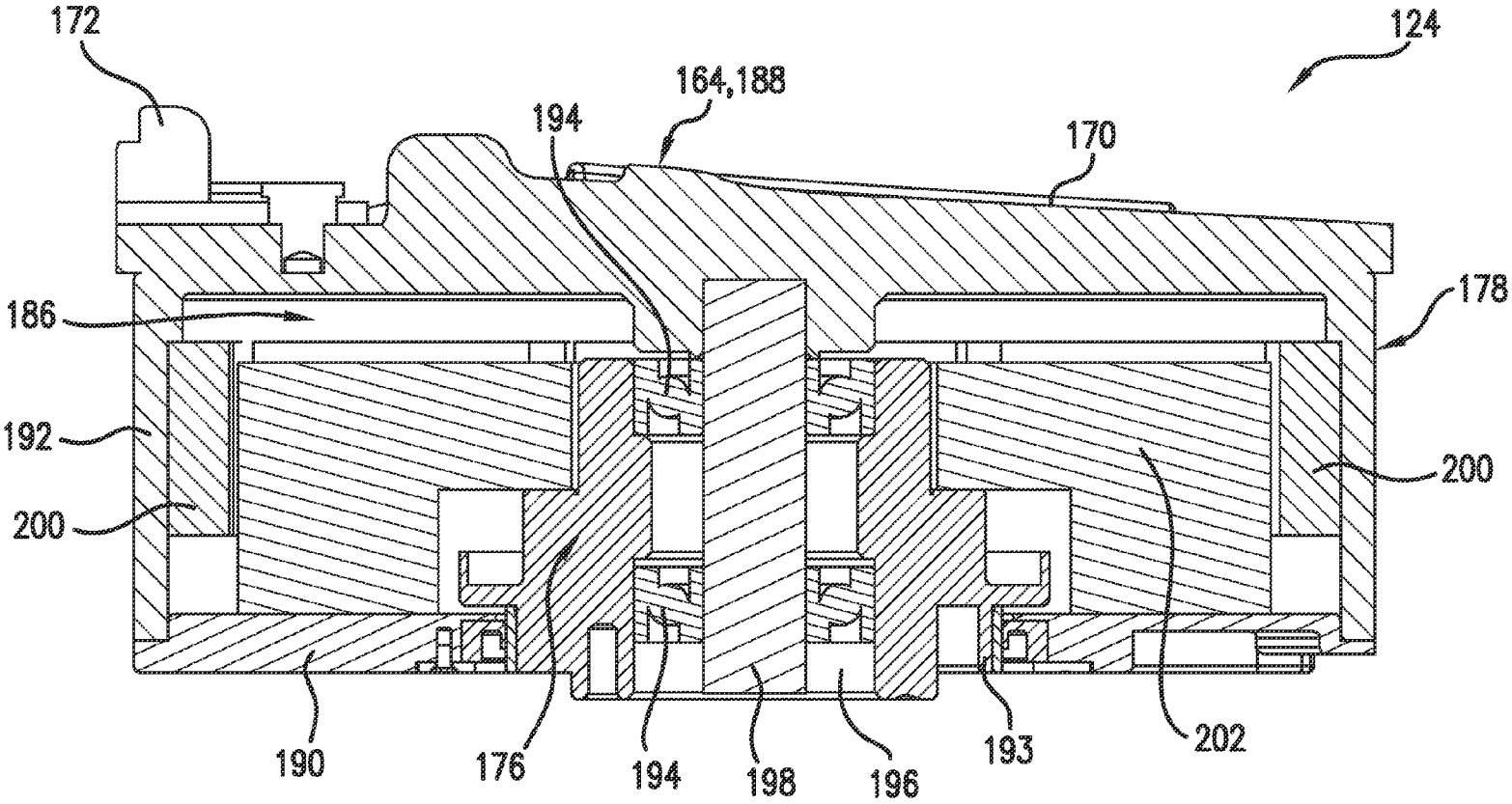
FIG. 8 illustrates a cross-sectional view of an alternative configuration for a motor of the waste disposal shown in FIGS. 6 and 7.

In an alternative embodiment, a shaftless connection may be defined between the cutter plate 164 and the motor 124 using any other suitable connection means, such as by forming the cutter plate 164 as an integral part of the rotor 178. For instance, FIG. 8 illustrates a cross-sectional view of the motor 124 described above with reference to FIGS. 6 and 7 with the cutter plate 164 being formed integrally with the rotor 178. As shown in FIG. 8, in such an embodiment, the cutter plate 164 may generally be configured to define all or a portion of the top wall 188 of the rotor 187, with the rotor sidewall 192 extending axially between the cutter plate 164 and the bottom wall 190 of the rotor 178.

Figure 9:
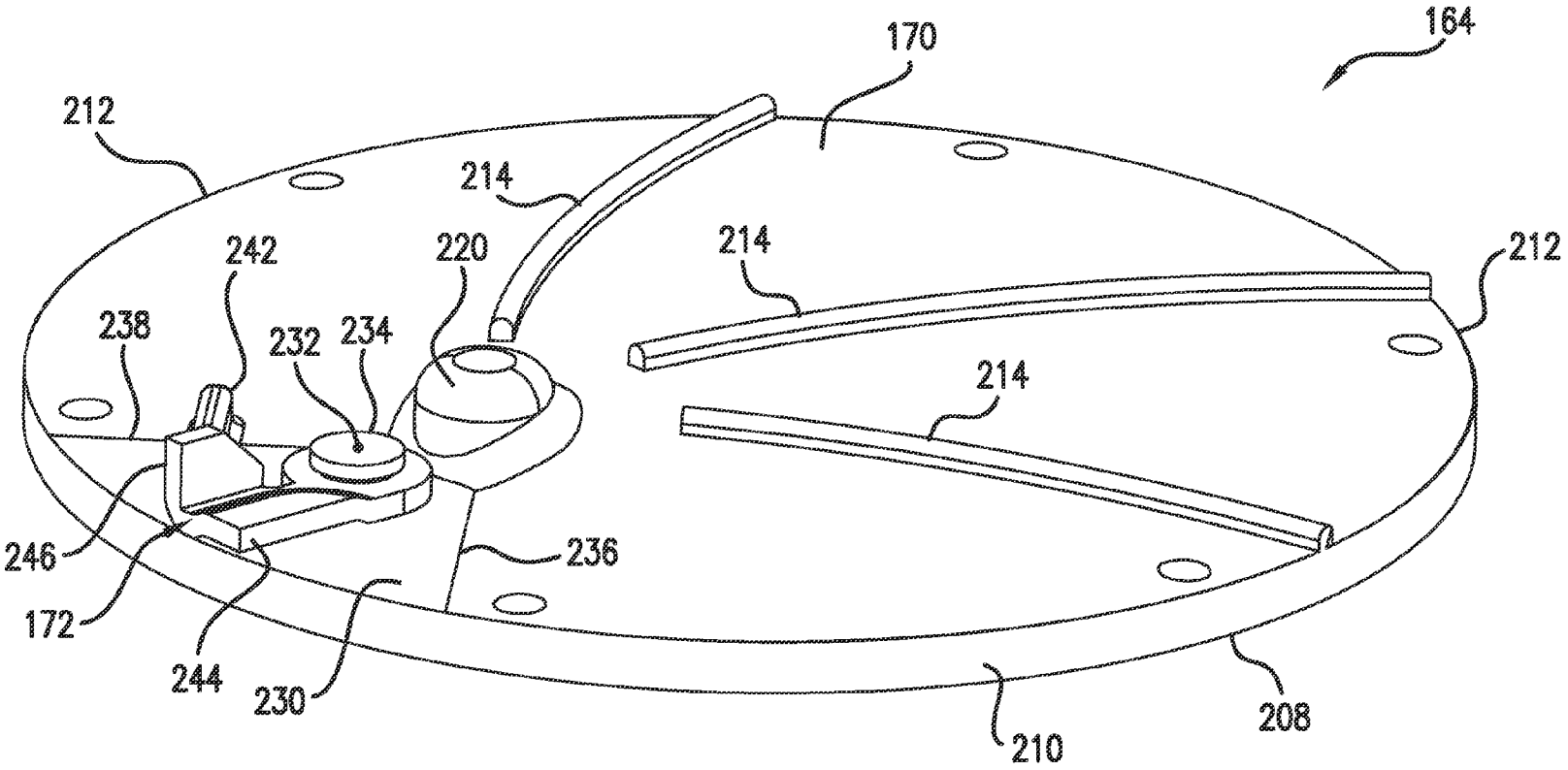
FIG. 9 illustrates a perspective view of a cutter plate of the waste disposal shown in FIGS. 6 and 7.
Figure 10:
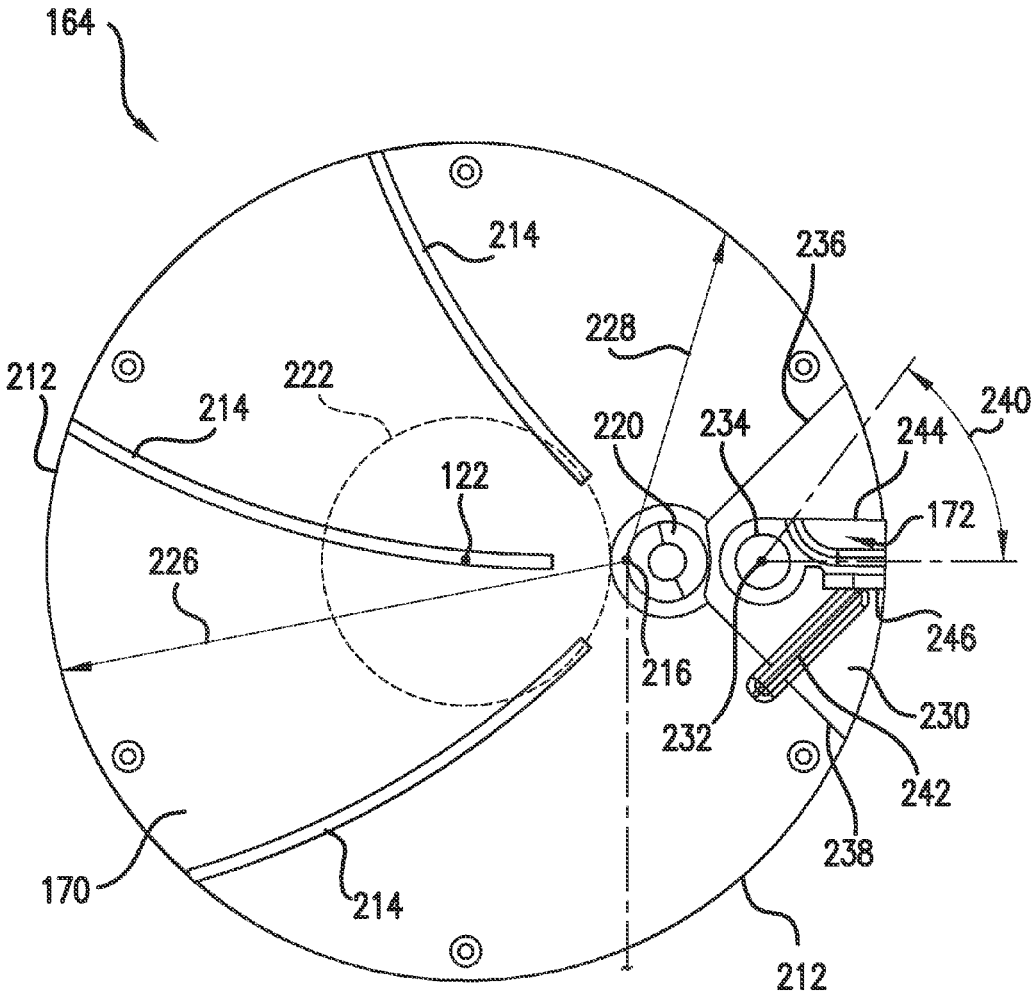
FIG. 10 illustrates a top view of the cutter plate shown in FIG. 9.
Figure 11:
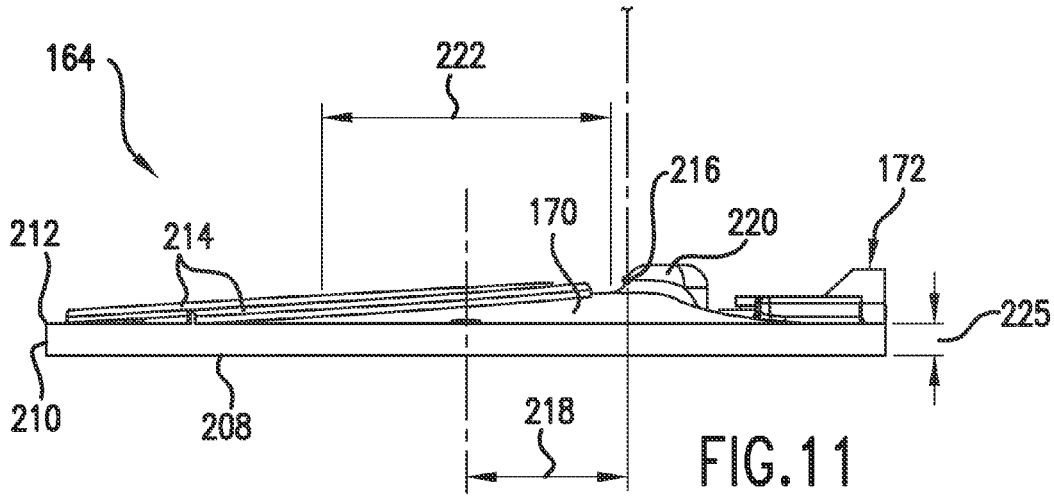
FIG. 11 illustrates a side view of the cutter plate shown in FIG. 10.

Referring now to FIGS. 9-11, several views of the cutter plate 164 described above with reference to FIGS. 6-8 are illustrated in accordance with aspects of the present subject matter. Specifically, FIG. 9 illustrates a perspective view of the cutter plate 164. Additionally, FIG. 10 illustrates a top view of the cutter plate 164 and FIG. 11 illustrates a side view of the cutter plate 164 shown in FIG. 10.

For ease of illustration and description, the cutter plate 164 is illustrated in FIGS. 9-11 as being formed as a separate component configured to be separately attached to the rotor 178 (e.g., the configuration shown in FIGS. 6 and 7). However, it should be appreciated that the surface features and other design features described below with reference to the cutter plate 164 may be similarly included within embodiments in which the cutter plate 164 is formed integrally with the rotor 168 (e.g., the configuration shown in FIG. 8).

As shown in FIGS. 9-11, the cutter plate 164 may generally correspond to a disk-shaped body including an upper surface 170, a lower surface 208 and a sidewall 210 extending circumferentially around the outer perimeter of the cutter plate 164 between the upper and lower surfaces 170, 208. Additionally, the cutter plate 164 may define a circumferentially extending outer edge 212 around its perimeter at the intersection of upper surface 170 and the sidewall 210.

As indicated above, the upper surface 170 of the cutter plate 164 may include one or more surface features configured to assist in directing water and/or waste radially outwardly towards the outer edge 212 of the plate 164 (and, thus, towards the stationary cutter ring 168 (FIG. 6)). For instance, in several embodiments, at least a portion of the upper surface 170 may be angled or sloped so that water/waste falling onto the cutter plate 164 via the primary outlet 142 may be directed down the sloped surface due to gravity and the centripetal forces generated as the cutter plate 164 is rotated. In addition, one or more ribs or fins 214 may be formed along the upper surface 170 to further urge water/waste radially outwardly towards the outer edge 212 of the cutter plate 164.

In forming the sloped upper surface 170 of the cutter plate 164, a high point (indicated by points 216 in FIGS. 10 and 11) may be defined on the upper surface 170 from which at least a portion of the surface is sloped or angled downwardly towards the outer edge 212 of the plate 164. In several embodiments, the location of such high point 216 may be offset from the rotational axis 122 of the motor 124. For example, as shown in FIG. 11, the high point 216 is located at a distance 218 from the rotational axis 122. By offsetting the high point 216 of the sloped upper surface 170 from the rotational axis 122, the location on the surface 170 at which the rotational speed of the cutter plate 164 is equal to zero may be angled or sloped downwardly towards the outer edge 212 of the plate 164, thereby preventing waste from sticking or being held-up at this zero-speed location.

It should be appreciated that, in the illustrated embodiment, the high point 216 of the upper surface 170 is generally defined around an axial projection extending outwardly from the upper surface 170 so as to form a lug guard 220 for the cutter plate 164. However, in embodiments in which the cutter plate 164 does not include the illustrated lug guard 220, the upper surface 170 may, for example, be continuously sloped along portions of the surface area covered by the lug guard 220 so that the high point 216 is defined at a location within such area (e.g., at the center of the lug guard 220).

In addition to offsetting the high point 216 relative to the rotational axis 122, the location of the high point 216 may also be selected so that the high point 216 is disposed outside of a cutter plate area 222 defined on the upper surface 170 directly below the open area 143 (FIG. 4) forming the primary inlet 142 of the waste disposal 102. For purposes of description, this area is represented on the upper surface 170 of the cutter plate 164 in FIGS. 10 and 11 by the dashed circle 222 and the range 222, respectively. As shown in FIGS. 10 and 11, the high point 216 is located outside this bounded area 222. Accordingly, as waste is directed through the open area 143 defined by primary inlet 142 and falls downward onto the cutter plate 164 within the bounded area 222, it can be ensured that the waste contacts the cutter plate 164 along the sloped portion of the upper surface 170. As a result, the waste may slide downward along the sloped surface toward the outer edge 212 of the cutter plate 164 as the plate 164 is rotated by the motor 124.

Moreover, in several embodiments, the specific slope or angle of the sloped portion of the upper surface 170 may be varied at different locations along the surface 170. Specifically, in one embodiment, the slope of the upper surface 170 may be varied so that the outer edge 212 of the cutter plate 164 is located within the housing 130 at a constant or substantially constant height 224 (FIG. 7) relative to a fixed reference point. For example, as shown in FIG. 7, to increase the contact area of the stationary cutter ring 168, it may be desirable for the outer edge 212 to be positioned at a constant height 224 within the housing 130 (e.g., relative to the bottom wall 180 of the housing 130) around the entire outer perimeter of the cutter plate 164. In such instance, the slope of the upper surface 170 may be varied across the cutter plate 164 based on the offset configuration of the plate's high point 216 to allow for a such a constant height 224 to be achieved around the entire outer edge 212 of the plate 164. For example, as shown in FIG. 10, the angle defined by the portion of the sloped surface extending radially outwardly from the high point 216 along arrow 226 may be smaller than the angle defined by the portion of the sloped surface extending radially outwardly from the high point 216 along arrow 228 given the differing radial distances defined between the high point 216 and the outer edge 212 along such arrows 226, 228.

Additionally, in several embodiments, it may be desirable for the sidewall 210 to define a constant or substantially constant height 225 (FIG. 11) between the upper and lower surfaces 170, 208 of the cutter plate 164. In such embodiments, the slope of the upper surface 170 may be similarly varied so that the sidewall 210 defines a given height 225 around the entire outer perimeter of the plate 164

It should be appreciated that, in general, the sloped portion of the upper surface 170 may be configured to define any suitable slope angle (i.e., the angle defined between a reference plane extending parallel to the plane defined by the outer edge 212 and a reference plane extending tangential to any location along the sloped portion. However, in several embodiments, the slope angle may generally range from greater than 0 degrees to less than 30 degrees, such as from about 2 degrees to about 25 degrees or from about 5 degrees to about 15 degrees and any other subranges therebetween. In such embodiments, the radially extending sections of the sloped portion of the upper surface 170 defining the longest radial distances between the high point 216 and the outer edge 212 (e.g., along arrow 226) may, for example, define slope angles falling within the lower portion of the above-described range (e.g., slope angles ranging from greater than 0 degrees to about 15 degrees) while the radially extending sections of the sloped portion defining the shortest radial distances between the high point 216 and the outer edge 212 (e.g., along arrow 228) may, for example, define slope angles falling with the upper portion of such range (e.g., angles ranging from about 15 degrees to less than 30 degrees).

As indicated above, the cutter plate may also include one or more fins 214 projecting axially from the upper surface 170. In general, the fins 214 may be configured to assist in directing waste radially outwardly towards the outer edge 212 of the cutter plate 164 as the plate 164 is rotated. In addition, the fins 214 may also be utilized to agitate the water contained within the grind chamber 116, which may assist in cleaning the chamber 116.

In several embodiments, the fins 214 may be configured to extend lengthwise along the sloped portion of the upper surface 170 at least partially between the high point 216 and the outer edge 212 of the cutter plate 164. For example, as shown in FIGS. 9 and 10, the fins 214 generally define continuously curved paths extending from a location adjacent to the high point 216 to the outer edge 212. However, in other embodiments, the fins 214 may define straight paths or any other suitably shaped paths extending between the high point 216 and the outer edge 212.

Moreover, as shown in FIG. 9, in addition to the sloped portion of the upper surface 170, the upper surface 170 may also define a flattened or recessed area 230 adjacent to its outer edge 212 to accommodate the cutter lug 172 of the cutter plate 164. For example, as shown in the illustrated embodiment, the cutter lug 172 may be configured to be rotatably coupled to the cutter plate 164 at a pivot point 232 defined along the recessed area 230 (e.g., via a suitable fastener, such as pin 234). As such, the cutter lug 172 may be configured to pivot about the pivot point 232 along the recessed area 230. In one embodiment, the cutter lug 172 may be allowed to pivot across the entire recessed area 230, such as from a forward edge 236 of the recessed area 230 to an aft edge 238 of the recessed area 230.

Alternatively, the cutter lug 172 may only be allowed to pivot along the recessed area 230 across a given pivot range 240 (FIG. 10). For instance, as shown in FIG. 10, the cutter plate 164 may include a stopper rib 242 extending outwardly from the recessed area 230 that serves to limit the rotation of the cutter lug 172 in the clockwise direction. In such an embodiment, the pivot range 240 may generally be defined by the angular range of movement provided between when a forward edge 244 of the lug 172 contacts the forward edge 236 of the recessed area 230 and when an aft edge 246 of the lug 172 contacts the stopper rib 242. For example, in several embodiments, the limited pivot range 240 may correspond to an angle ranging from about 20 degrees to about 90 degrees, such as from about 25 degrees to about 80 degrees or from about 30 degrees to about 70 degrees and any other subranges therebetween.

Moreover, as indicated above, the cutter plate 164 may also include an axially projecting lug guard 220 extending outwardly from the upper surface 170. As shown in FIGS. 9 and 10, the lug guard 220 may generally be configured to be positioned along the upper surface 170 at a location radially inwardly from the cutter lug 172. Accordingly, if a user has inserted his/her finger into the disposal, the lug guard 220 may serve to restrict user access to the location of the cutter lug 172, thereby preventing injuries that may otherwise occur if the user's finger is allowed to contact the lug 172.

It should be appreciated that, in several embodiments, the maximum slope angle for the sloped portion of the upper surface 170 may be utilized to define the high point 216 of the upper surface 170 or to otherwise distinguish the high point 206 from axial projections extending outwardly from the upper surface 170. For example, as indicated above, in one embodiment, the maximum slope angle of the sloped portion of the upper surface 170 may correspond to 30 degrees. In such an embodiment, the high point 216 may be defined along the upper surface 170 only at a location at which both the angle defined between a reference plane extending parallel to plane defined by the outer edge 212 of the cutter plate 164 and a reference plane extending tangential to the surface at the high point is less than 30 degrees (or any other maximum slope angle set for the upper surface 170) and a continuous surface is defined across such location between the high point and a section(s) of the sloped portion of the upper surface 170. Thus, referring to the illustrated embodiment, the sides and upper surfaces of the various components projecting axially from the upper surface 170 (e.g., the fins 214, the cutter lug 172, the stopper rib 242 and the lug guard 220) may not be considered the high point 216 due to the sides defining excessive slope angles and the fact that a continuous surface is not defined between the upper surfaces and a section(s) of the sloped portion of the upper surface 170 (i.e., due to the sides of such components).

In addition to the various cutter plate features, the disclosed waste disposal 102 may also include one or more water management features configured such that water (and the processed waste carried by such water) is moved effectively and efficiently through the disposal 102 and properly discharged from the housing 130 via the discharge outlet 154. For example, in several embodiments the waste disposal 102 may include a deflector feature configured to prevent water from flowing and/or splashing out of the grind chamber 166 through the primary inlet 142. In addition, the waste disposal 102 may include a turbine feature that acts like a pump to draw water (and processed waste) from the grind chamber 166 axially downward along an inner sidewall surface 248 (FIG. 15) of the housing 130 for subsequent discharge therefrom via the discharge outlet 154. Moreover, the waste disposal 102 may also include additional pump-like features defined along the bottom of the motor 124 to push water and processed waste radially outwardly along the bottom wall 180 of the housing 130 towards the discharge outlet 154.

Figure 12:
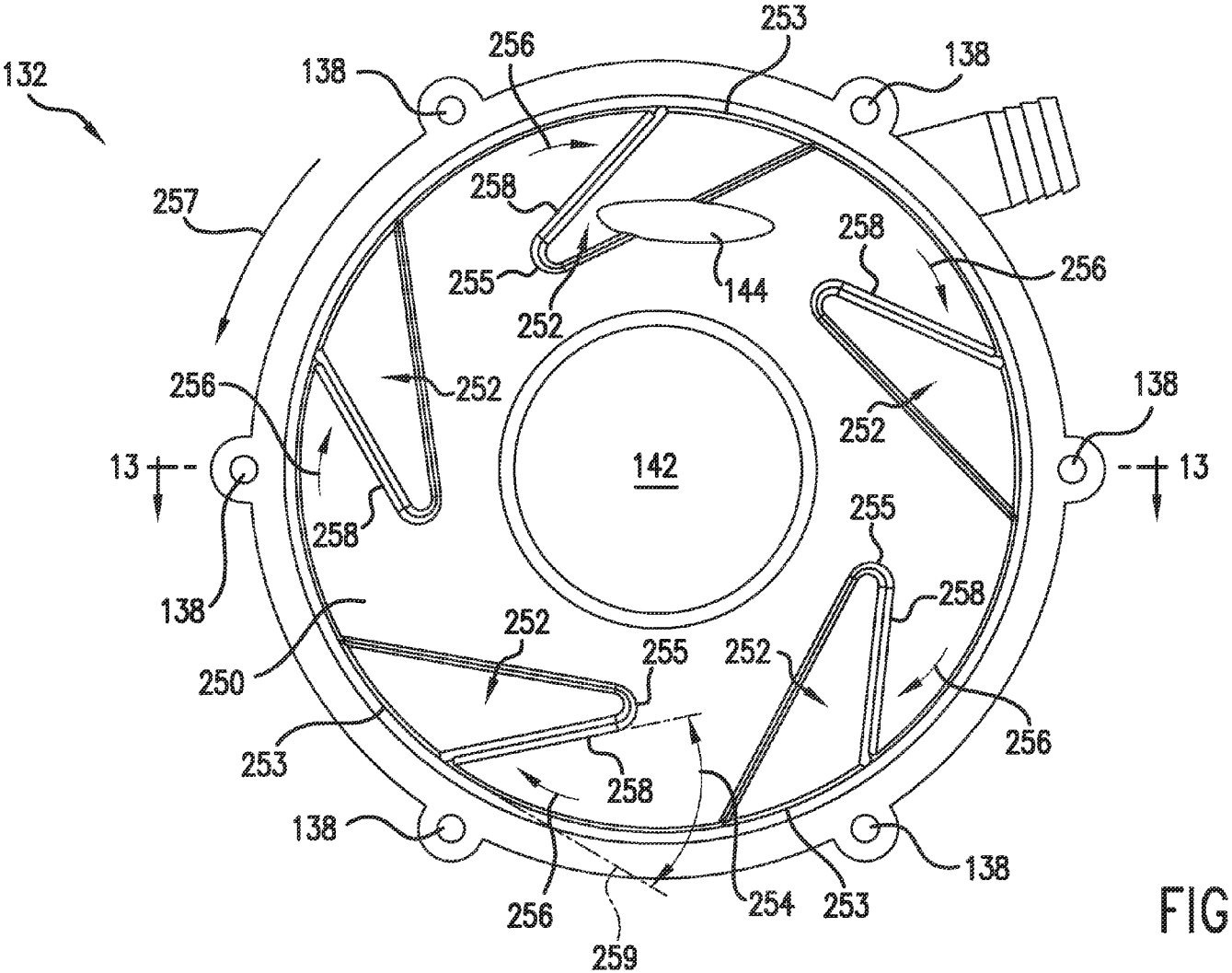
FIG. 12 illustrates a bottom view of an upper portion of the housing of the waste disposal shown in FIGS. 2-7.

As indicated above, during operation of the disclosed waste disposal 102, water entering the grind chamber 166 and falling onto the cutter plate 134 is directed radially outwardly towards the outer edge 212 of the plate 164 due to the centripetal forces in combination with the various surface features defined on the plate 164 (e.g., the sloped upper surface 170 and the fins 214). As the water is forced radially outwardly towards the outer edge 212, it begins to spin in the rotational direction of the cutter plate 164 and may tend to flow upward in a spiral-like pattern along the dome-shaped inner surface 250 of the upper housing portion 132 towards the primary inlet 142. To prevent such upward flowing water from splashing out or otherwise being discharged from the inlet 142, the waste disposal 102 may include a plurality of deflector ribs 252 defined along the inner surface 250 of the upper housing portion 132. Specifically, the ribs 252 may be configured to interrupt or disrupt the flow of water along the inner surface 250 of the upper housing portion 132, thereby causing the water to forced back down onto the cutter plate 164. Such ribs 252 will generally be described below with reference to FIGS. 12-14. Specifically, FIG. 12 illustrates a bottom view of the upper housing portion described above with reference to FIGS. 2-7, particular illustrating a straight-on view of the dome-shaped inner surface 250 of the upper housing portion 132. Additionally, FIG. 13 illustrates a cross-sectional side view of the upper housing portion 132 shown in FIG. 12 taken about line 13-13 and FIG. 14 illustrates a close-up view of a portion of the upper housing 132 shown in FIG. 13.

Figure 13:
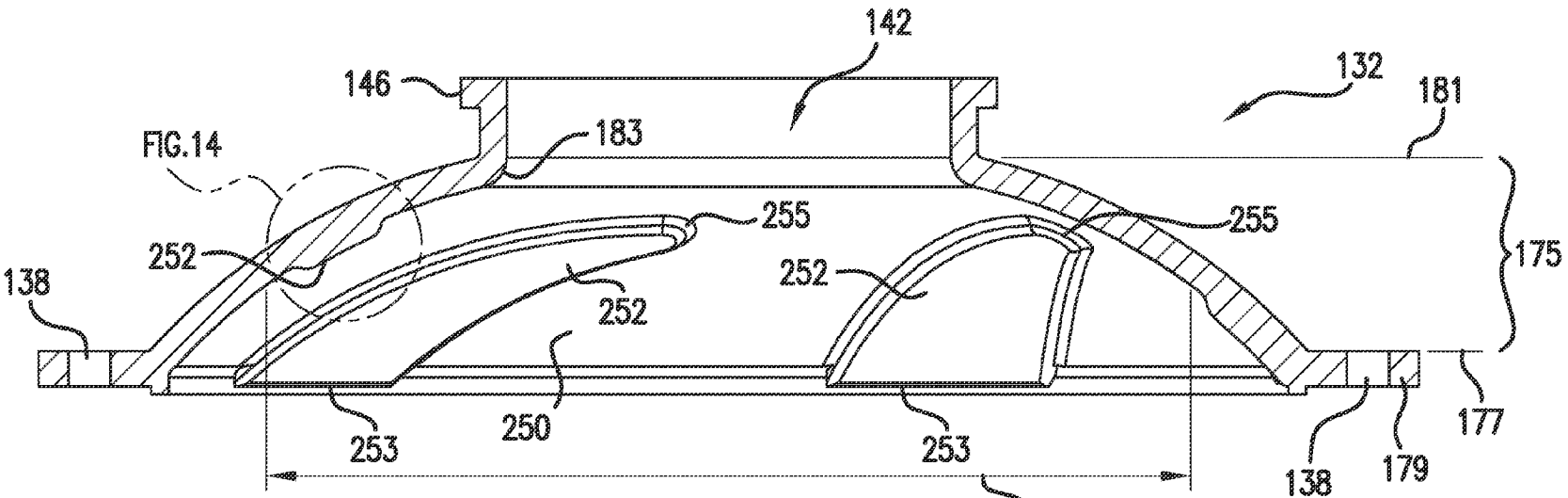
FIG. 13 illustrates a cross-sectional side view of the upper portion of the housing shown in FIG. 12 taken about line 13-13.
Figure 14:
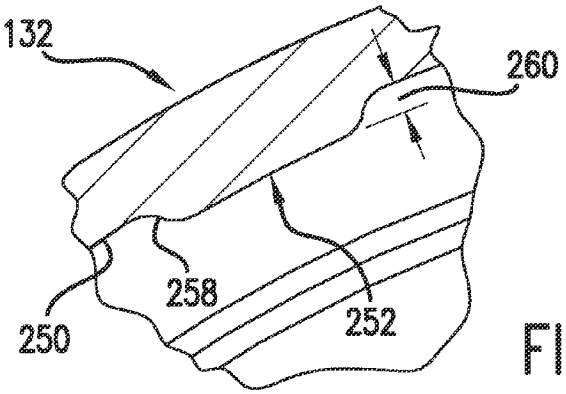
FIG. 14 illustrates a magnified, cross-sectional view of a portion of the housing shown in FIG. 13.

As shown in FIGS. 12-14, the ribs 252 may generally be configured as raised projections extending outwardly from the inner surface 250 of the upper housing portion 132. In several embodiments, the ribs 252 may be configured to extend lengthwise along the converging section 175 of the upper housing portion 132. Specifically, as shown in FIG. 13, each rib 252 may generally be configured to extend along the dome-shaped inner surface 250 of the upper housing portion 132 between a base end 253 and a tip end 255, with the base end 253 being positioned at or adjacent to the first end 177 of the converging section 175 and the tip end 255 being positioned at or adjacent to the second end 181 of the converging section 175.

Additionally, as particularly shown in FIG. 12, in several embodiments, the ribs 252 may be oriented along the converging section 175 such that the ribs 252 wrap circumferentially around the inner surface 250 in a spiral-like pattern. In such embodiments, the spiral-like pattern formed by the ribs 252 may generally be oriented in a circumferential direction (indicated by arrow 257) that is opposite to the spiral-like flow path of the water flowing upwards along the inner surface 250 (i.e., in a direction opposite to the direction of rotation of the motor 124). For example, as shown in FIG. 12, if the cutter plate 164 is rotated such that water is being directed upwards along the inner surface 250 in a clockwise spiraling pattern (indicated by arrows 256), the ribs 252 may be angled along the inner surface 250 in a counter-clockwise spiraling pattern. As a result, the water may contact a forward, angled edge 258 of each rib 252 as it flows upwards along the inner surface 250, thereby interrupting the spiraling flow path and causing the water to be forced back down into the cutter plate 164.

As shown in FIG. 12, due to the circumferential orientation of the ribs 252, an edge angle 254 may be defined at the forward edge 258 of each rib 252 that is referenced relative to a line 259 extending tangentially to the inner surface 250 of the at the intersection of the base 253 and the forward edge 258 of each rib 252. It should be appreciated that the edge angle 254 may generally correspond to any suitable angle that allows the ribs 252 to function as described herein. However, in several embodiments, the edge angle 254 may range from about 5 degrees to about 80 degrees, such as from about 15 degrees to about 70 degrees or from about 30 degrees to about 60 degrees and any other subranges therebetween. Additionally, a height 260 (FIG. 14) of each rib 252 relative to the inner surface 250 may generally correspond to any suitable height that allows the ribs 252 to disrupt the flow of water along the inner surface 250. In general, it has been found that, as the height 260 of each rib 252 is increased, the axial distance over which the water flows upward along the inner surface 250 may be decreased.

Figure 15:
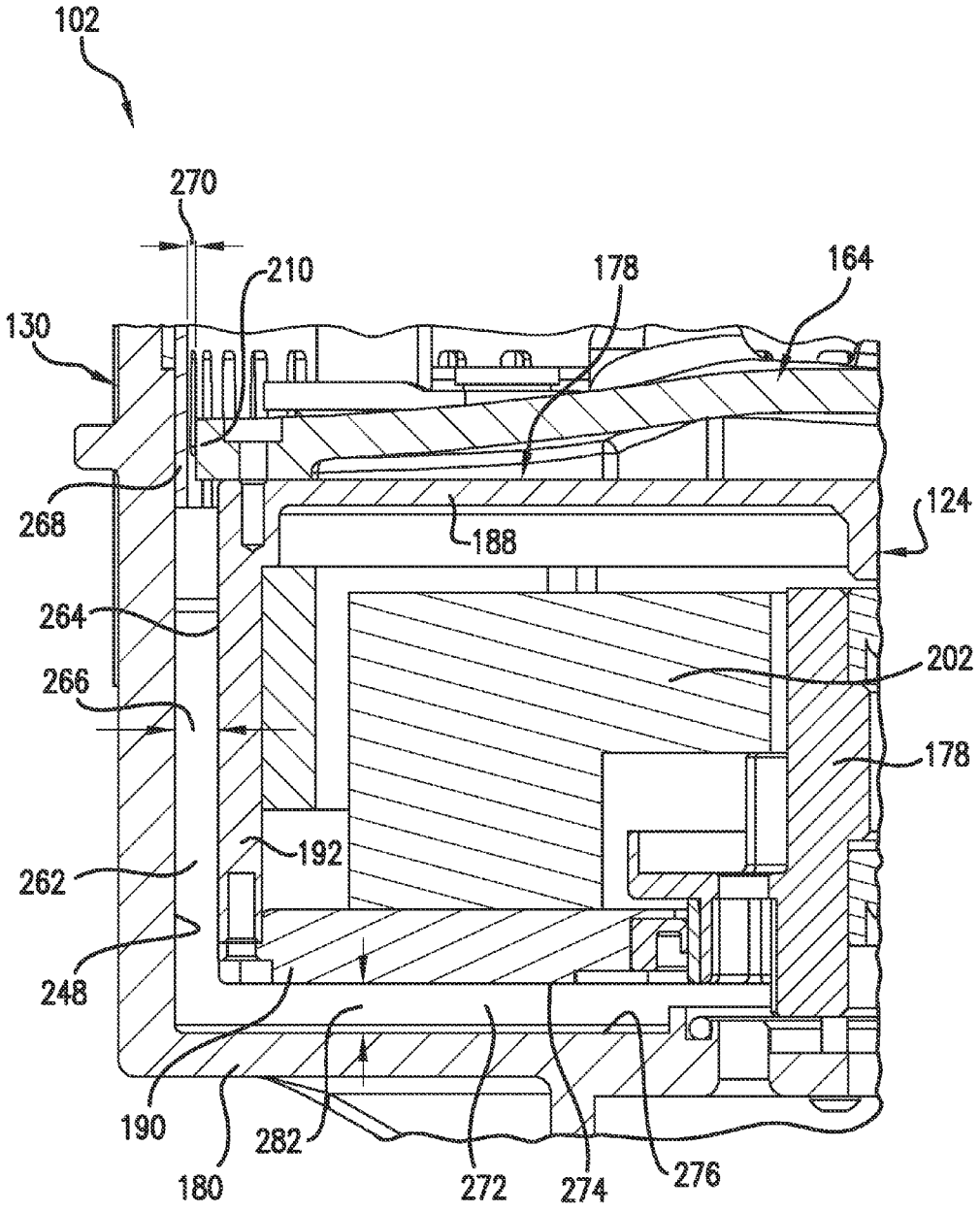
FIG. 15 illustrates a magnified, cross-sectional view of a portion of the waste disposal shown in FIG. 6.

Moreover, as indicated above, the waste disposal 102 may also include a turbine feature that acts like a pump to draw water and processed waste axially downwards towards the discharge outlet 154. Specifically, in several embodiments, an annular gap 262 may be defined between the housing 130 and the sidewall 192 of the rotor 178 that allows the rotating sidewall 192 to function similar to a centripetal, bladeless water turbine. A close-up, cross-sectional view of a portion of the cross-section shown in FIG. 6 is illustrated in FIG. 15, which particularly illustrates the annular gap 262 defined between the housing 130 and the rotor sidewall 192. As shown in FIG. 15, the gap 262 may be defined directly between the inner sidewall surface 248 defined around the inner perimeter of the housing 130 (e.g., the inner perimeter of the lower housing portion 133) and an outer surface 264 of the rotor sidewall 192.

By defining such an annular gap 262 between the rotating sidewall 192 and the housing 130, the surface tension between the adjacent surfaces 248, 264 of the housing 130 and the sidewall 192, together with the pressure of the water within the housing 130 and gravity, may be utilized to create a pumping action that pulls water and processed waste downward within the housing 130. Specifically, by placing the adjacent surfaces 248, 264 in close proximity, the surface tension between the surfaces 248, 264 may be increased. Additionally, as water flows within and fills the annular gap 262, an increase in viscosity and adhesion between the surfaces 248, 264 may occur. Combined with the high speed rotation of the rotor 178, such increases in the surface-related parameters of the adjacent surfaces 248, 264 assist in creating the pumping action that aids in discharging the water and processed waste from the housing 130.

In several embodiments, a width 266 of the annular gap 262 may be selected such that a desired pumping action is achieved. In general, the required width 266 of the annular gap 262 may vary depending on numerous factors, including, but not limited to, the volume of water flowing through the disposal 102, the amount of waste particulates contained within the water, the desired discharge rate for the disposal 102 and/or any other relevant factors. However, in several embodiments, the width 266 of the annular gap 262 may generally range from about 0.5 millimeters (mm) to about 10 mm, such as from about 2 mm to about 9 mm or from about 4 mm to about 8 mm and any other subranges therebetween.

In addition to the annular gap 262 defined between the housing 130 and the rotor sidewall 192, a second annular gap 268 may also be defined between the inner sidewall surface 248 of the housing 130 and the sidewall 210 of the cutter plate 164 (which may, in some embodiments, correspond to a side surface of the top wall 188 of the rotor 178). In several embodiments, a width 270 of the second annular gap 268 may be the same as the width 266 of the annular gap 262 defined between the housing 130 and the rotor sidewall 192. Alternatively, the widths 266, 270 of such annular gaps 262, 268 may differ. For example, as shown in FIG. 15, the width 270 of the second annular 268 gap is less than the width 266 of the annular gap 262 defined between the housing 130 and the rotor sidewall 192. Such a narrowed gap 268 at the upper portion of the rotor/cutter plate may, in several embodiments, allow for an enhanced pumping action to be created between the rotor 178 and the housing 130. Specifically, the narrowed gap 268 may allow for closer grinding or processing of the solid waste and, thus, may reduce the potential for build-up between the housing 130 and the rotor 178. However, in an alternative embodiment, the width 270 of the second annular gap 268 may be greater than the width 266 of the annular gap 262 defined between the housing 130 and the rotor sidewall 192.

Figure 16:
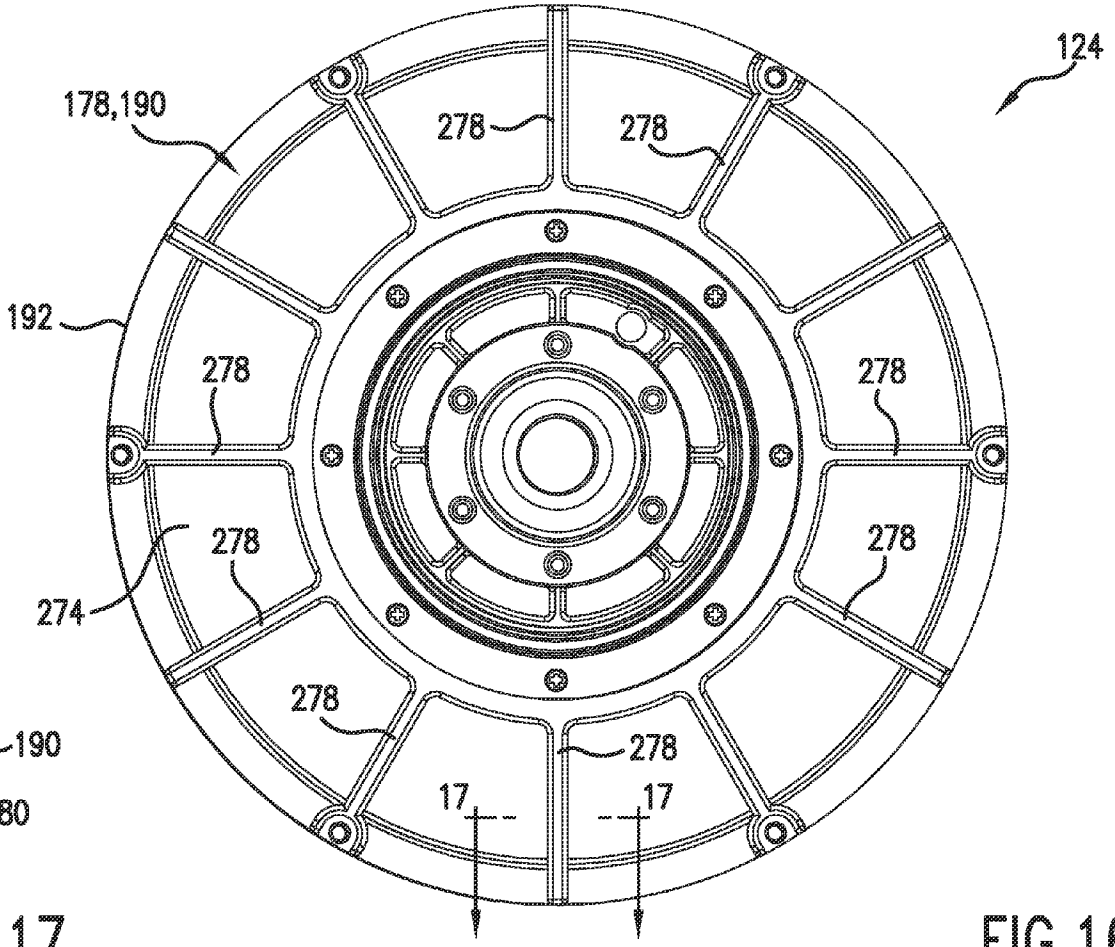
FIG. 16 illustrates a bottom view of the motor of the waste disposal shown in FIGS. 6-8.

Moreover, as shown in FIG. 15, to provide clearance for rotating the rotor 178 relative to the housing 130, a bottom gap 272 may also be defined between a lower surface 274 of the bottom rotor wall 190 and a bottom surface 276 of the interior of the housing 130. To prevent water and processed waste from collecting within such gap 272, the bottom wall 190 of the rotor 178 may, in several embodiments, include one or more ribs 278 configured to push water and processed waste radially outwardly towards the inner sidewall surface 248 of the housing 130. For example, FIG. 16 illustrates a bottom view of the motor 124 shown in FIGS. 6-8, particularly illustrating a view of the lower surface 274 of the bottom wall 190 of the rotor 178. Additionally, FIG. 17 illustrates a partial, cross-sectional view of the bottom wall 190 of the rotor 178 shown in FIG. 16 taken about line 17-17.

Figure 17:
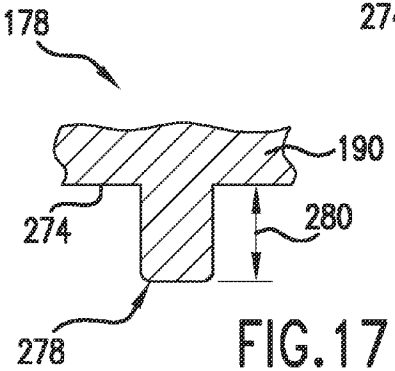
FIG. 17 illustrates a cross-sectional view of a portion of the motor shown in FIG. 16 taken about line 17-17.

As shown in FIGS. 16 and 17, a plurality of axially projecting ribs 278 may be formed along the bottom rotor wall 190. As particularly shown in FIG. 16, in several embodiments, the ribs 278 may be configured to extend lengthwise along the lower surface 274 of the bottom rotor wall 190 in a substantially radial direction. Alternatively, the ribs 278 may be angled relative to the radial direction so that the ribs 278 form a spiral-like pattern along the bottom rotor wall 190. Regardless, such ribs 278 may be configured to act like impeller or turbine blades so that, as the rotor 178 is rotated, the ribs 278 may force water and processed waste contained within the bottom gap 272 radially outwardly for subsequent discharge from the housing 130 via the discharge outlet 154.

It should be appreciated that the ribs 278 may generally be configured to project axially from the lower surface 274 of the bottom rotor wall 190 so as to define any suitable height 280 (FIG. 17). For example, in several embodiments, the height 280 of each rib 278 may be equal to a distance ranging from about 30% to about 95% of a height 282 of the bottom gap 272, such as a distance ranging from about 60% to about 90% of the height 282 or from about 70% to about 85% of the height 282 and any other subranges therebetween.

Figure 18:
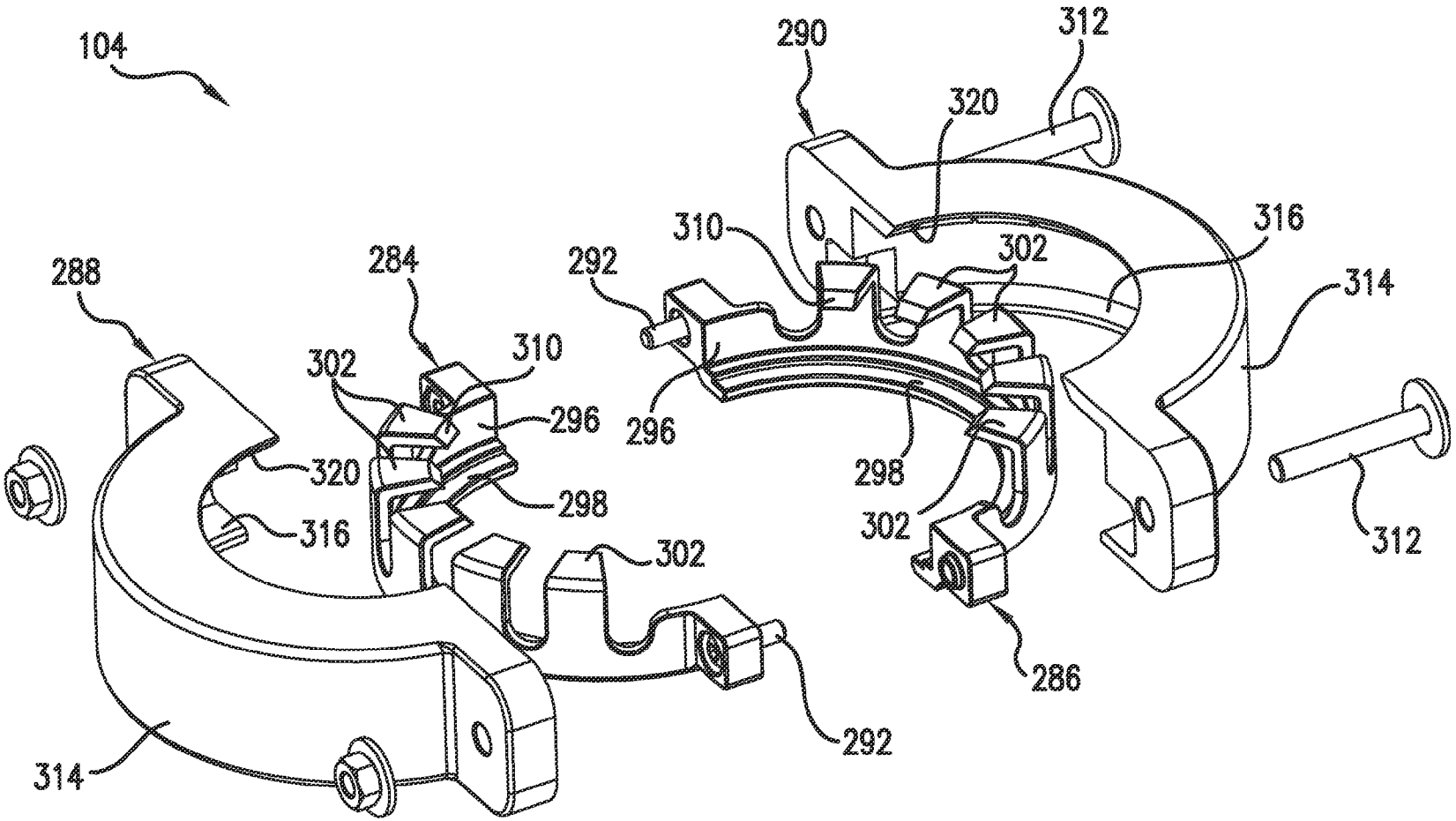
FIG. 18 illustrates an exploded, perspective view of the mounting assembly shown in FIG. 1, particularly illustrating inner mounting brackets and outer mounting brackets of the mounting assembly.
Figure 19:
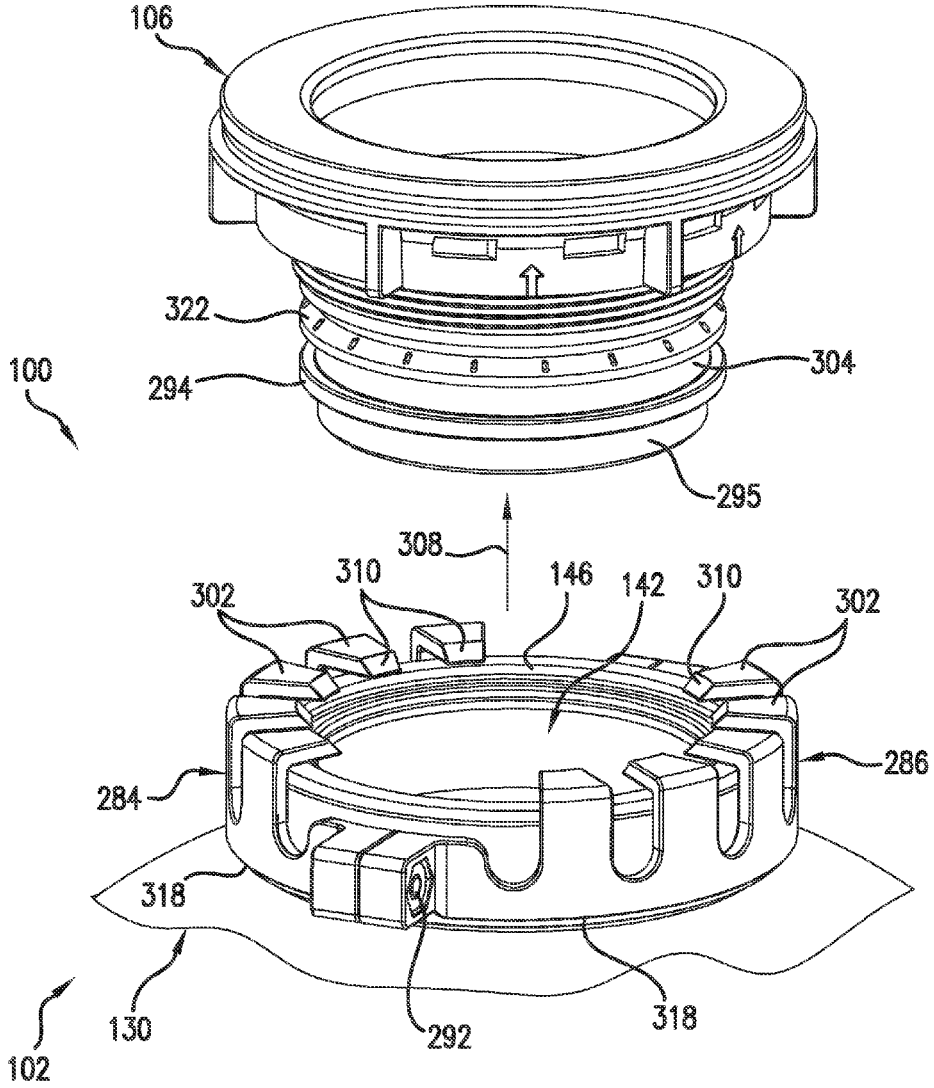
FIG. 19 illustrates a partial, perspective view of the waste disposal shown in FIGS. 2-5 with the inner mounting brackets shown in FIG. 18 mounted onto the top of the disposal housing, with the sink drain shown in FIG. 1 being exploded away from the waste disposal.
Figure 20:
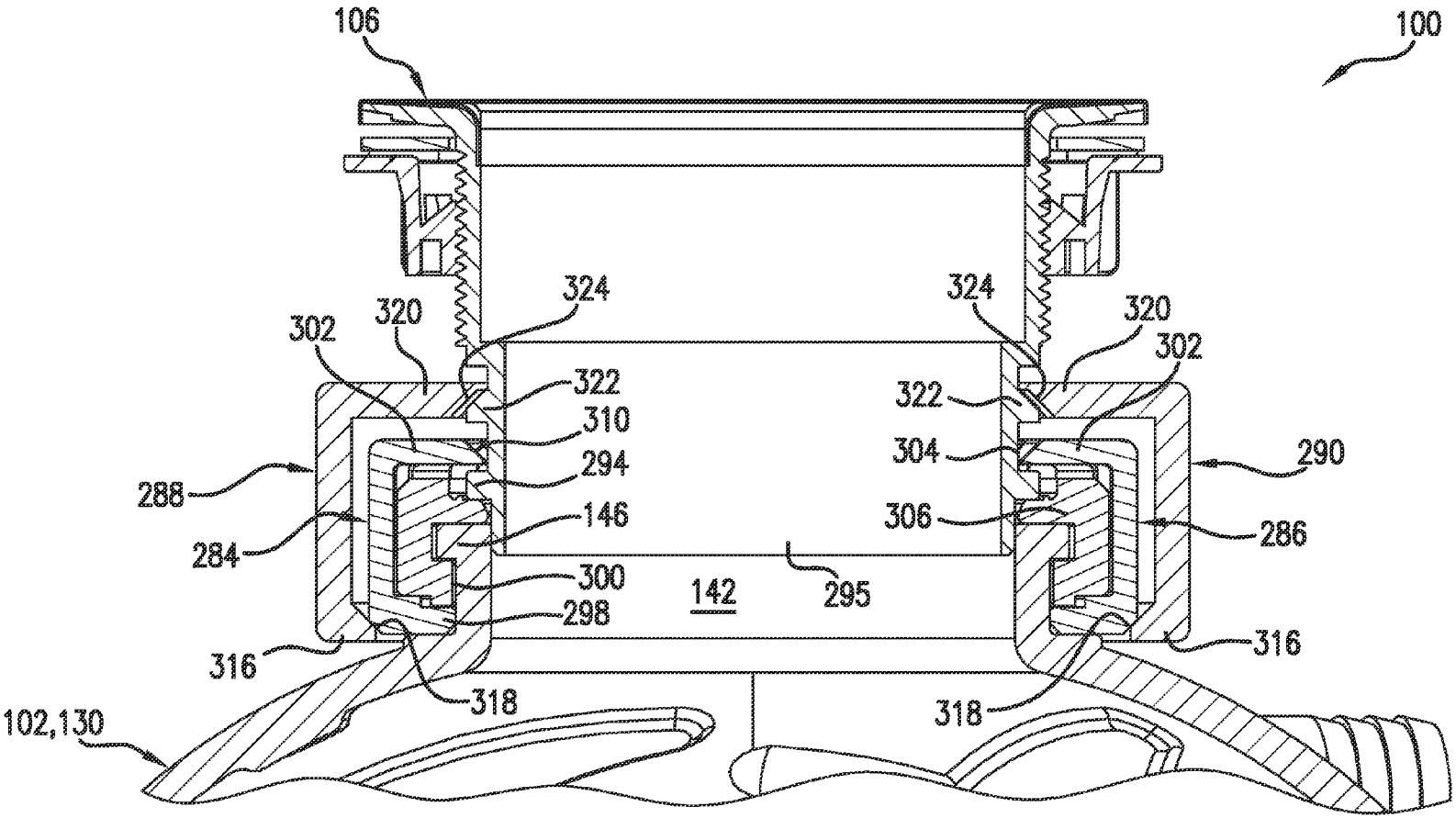
FIG. 20 illustrates a cross-sectional view of the connection between the waste disposal and the sink drain provided via the mounting assembly shown in FIG. 18.

Referring now to FIGS. 18-20, several views of the mounting assembly 104 described above for mounting the waste disposal 102 to the sink drain 106 are illustrated in accordance with aspects of the present subject matter. Specifically, FIG. 18 illustrates an exploded view of the mounting assembly 104. FIG. 19 illustrates a perspective view of a portion of the mounting assembly 104 installed onto the top 134 of the disposal housing 130, with the sink drain 106 exploded away from the housing 130. Additionally, FIG. 20 illustrates a cross-sectional view of the connection between the sink drain 106 and the waste disposal 102 with the mounting assembly 104 installed.

As shown in the illustrated embodiment, the mounting assembly 104 may include a pair of inner mounting brackets (e.g., a first inner mounting bracket 284 and a second inner mounting bracket 286) and a pair of outer mounting brackets (e.g., a first outer mounting bracket 288 and a second outer mounting bracket 290). The inner mounting brackets 284, 286 may generally be configured to be coupled to one another (e.g., using suitable mechanical fasteners 292, such as bolts, screws, pins, etc.) so as to form an inner mounting ring that extends and/or engages around the mounting flange 146 formed at the top 134 of the housing 130 and a corresponding drain flange 294 formed around a bottom portion 295 of the sink drain 106.

Specifically, as shown in FIGS. 18-20, each inner mounting bracket 284, 286 may include a body 296 (FIG. 18) having a mounting lip 298 that projects radially inwardly from the body 296 such that, when the brackets 284, 286 are coupled together, an annular lip 298 is defined around the inner circumference of the brackets 284, 286. This annular lip 298 may be configured to be positioned axially below the mounting flange 146 defined at the top 134 of the housing 130 when the inner mounting brackets 284, 286 are installed into the housing 130. For example, as shown in FIG. 20, the lip 298 may be configured to contact the housing 130 along a circumferential recess 300 formed directly below the mounting flange 146.

In addition, each inner mounting bracket 284, 286 may include a plurality of teeth 302 extending radially inwardly from its body 296. Each radially extending tooth 302 may generally be configured to engage the drain flange 294 formed around the bottom portion 295 of the sink drain 106. Specifically, as shown in FIG. 20, when the inner mounting brackets 284, 286 are properly installed onto the sink drain 106, each tooth 302 may be configured to overlap the drain flange 294 (e.g., by contacting a recessed portion 304 defined above the flange 294) so as to provide a means for vertically retaining the inner mounting brackets 284, 286 and the waste disposal 102 relative to the drain 106.

In several embodiments, when installing the inner mounting brackets 284, 286 onto the waste disposal 102, a suitable sealing mechanism 306 may be configured to be initially positioned onto and/or around the mounting flange 146. For instance, as shown in FIG. 20, an annular seal 306 may be installed onto the mounting flange 146 that extends around from the top of the flange 146 to the circumferential recess 300 defined below the flange 146. The inner mounting brackets 284, 286 may then be installed onto the housing 130 around both the mounting flange 146 and the seal 306, with the annular lip 298 formed by the mounting brackets 284, 286 contacting the circumferential recess 300 below the seal 306 such that a portion of the seal 306 is disposed directly between the lip 298 and the mounting flange 146. Thereafter, as shown in FIG. 19, the waste disposal 102 (with inner mounting brackets 284, 286 installed thereon) may be pushed upward onto the drain 106 (as indicated by the arrow 308). In doing so, the radially extending teeth 302 defined by the inner mounting brackets 284, 286 may be configured to flex or move radially outwardly as the brackets 284, 296 are pushed over the drain flange 294. For example, as shown in FIG. 18, an end surface 310 of each tooth 302 may be angled in a manner that urges the teeth 302 radially outwardly as they are pushed upward against the drain flange 294. As the teeth 302 are pushed to a location axially above the drain flange 294, the teeth 302 may snap or otherwise move back radially inwardly into the recessed portion 304 of the sink drain 106 so as to overlap the drain flange 294. As shown in FIG. 20, when the teeth 302 are properly positioned relative to the flange 204, the bottom portion 295 of the drain 106 may be received within the primary inlet 142 and a portion of the seal 306 may be positioned between the drain flange 294 and the top 134 of the housing 130. Additionally, as indicated above, with the teeth 302 engaged over the drain flange 294, the entire weight of the waste disposal 102 may be vertically supported via the connection provided by the inner mounting brackets 284, 286. Moreover, at this point, the disposal 102 may be configured to be rotated relative to the sink drain 106 (e.g., a full 360 degrees) to allow the disposal 102 to be aligned with existing plumbing drainage.

The outer mounting brackets 288, 290 may then be installed around the inner mounting brackets 284, 286 to complete installation processes.

As shown in the illustrated embodiment, the outer mounting brackets 288, 290 may generally be configured to be coupled to one another (e.g., using suitable mechanical fasteners 312, such as bolts, screws, pins, etc.) so as to form an outer mounting ring that engages around inner mounting brackets 284, 286. Specifically, each outer mounting bracket 288, 290 may include a body 314 (FIG. 18) having a lower mounting lip 316 that projects radially inwardly from the body 314 such that, when the brackets 288, 290 are coupled together, a lower annular lip 316 is defined around the inner circumference of the brackets 288, 290. This lower annular lip 316 may generally be configured to be engaged around the outer perimeter of each of the inner mounting brackets 284, 286, such as by configuring the lip 316 to be positioned against a lower edge 318 (FIG. 20) of each inner mounting bracket 284, 286 and/or to overlap below the lower edge 318.

Additionally, each outer mounting bracket 288, 290 may also include an upper mounting lip 320 that projects radially inwardly from its body 314 such that, when the brackets 288, 290 are coupled together, an upper annular lip 320 is defined around the inner circumference of the brackets 228, 290. This upper annular lip 320 may generally be configured to be engaged against a corresponding annular drain projection 322 formed around the sink drain 106 at a location axially above the drain flange 294. Specifically, as shown in FIG. 20, in one embodiment, the upper lip 320 and the drain projection 322 may define mating or matching angled end surfaces 324 such that the upper lip 320 locks against and remains engaged with the drain projection 322.

It should be appreciated that, in alternative embodiments, the mounting assembly 104 may have any other suitable configuration that allows the waste disposal 102 to be mounted onto the sink drain 106. For example, in one embodiment, the first and second inner mounting brackets 284, 286 may be configured as a single, ring-shaped mounting bracket. In such an embodiment, the ring-shaped inner mounting bracket may be configured to be coupled to the top 134 of the housing 130 using any suitable attachment means, such as by screwing the mounting bracket onto threads formed at the top 134 of the housing 130. Once installed onto the housing 130, the teeth 302 of the ring-shaped mounting bracket may then be pushed against and over the drain flange 294 in order to couple the waste disposal 102 to the drain 106.

As indicated above, the motor 124 of the disclosed waste disposal 102 may, in several embodiments, include a controller 340 (FIG. 21) configured to control the operation of the motor 124. In general, the controller 340 may comprise any suitable computing device and/or any other suitable processing unit. Thus, in several embodiments, the controller 340 may include one or more processor(s) and associated memory device(s) configured to perform a variety of computer-implemented functions (e.g., performing the methods, steps, calculations and the like disclosed herein). As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) may generally be configured to store suitable computer-readable instructions that, when implemented by the processor(s), configure the controller 340 to perform various functions including, but not limited to, receiving one or more parameter feedback signals associated with one or more operational parameters of the motor 124, controlling the operation of the motor 124 based on the monitored operational parameter(s) and/or various other suitable computer-implemented functions.

Figure 21:
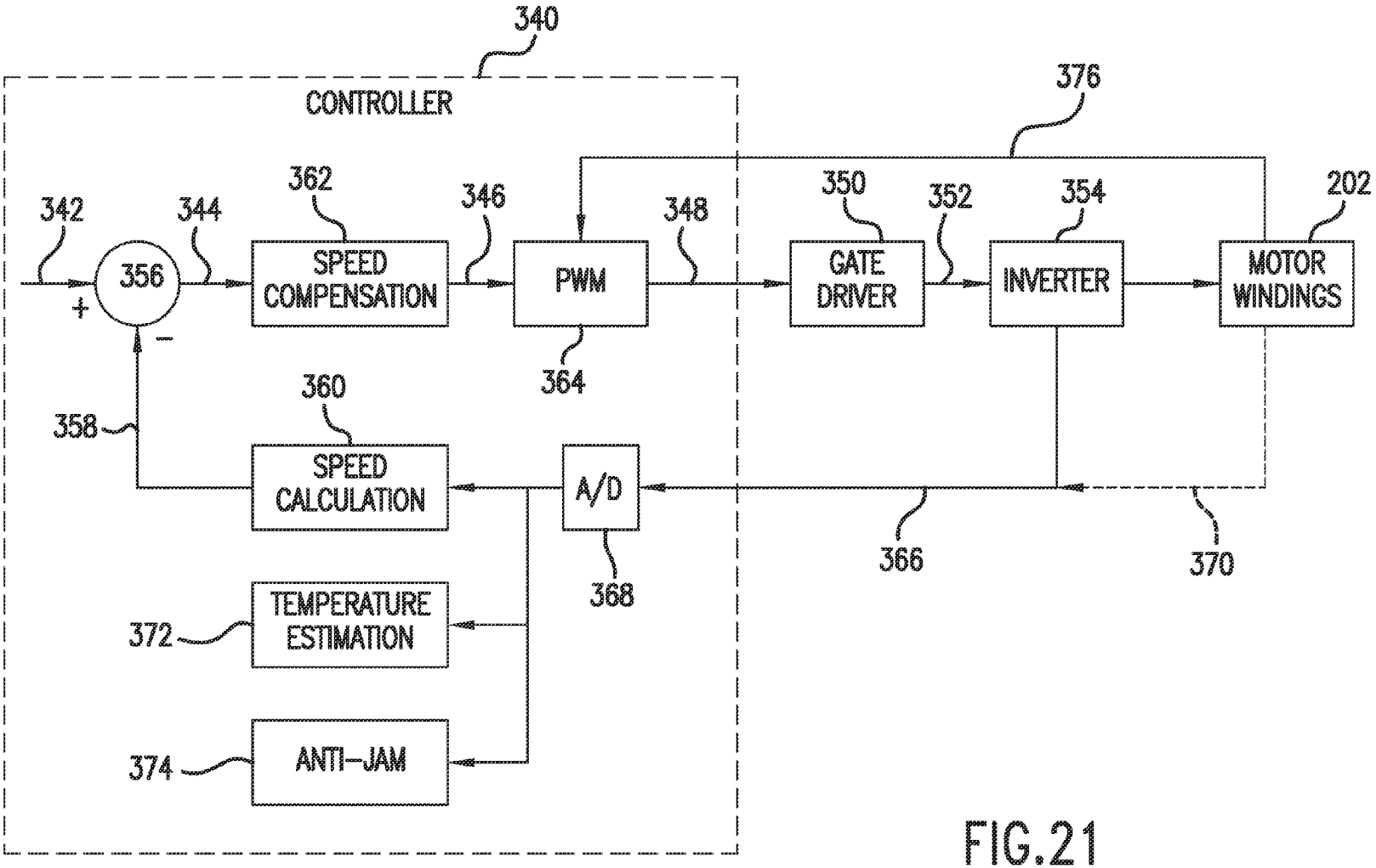
FIG. 21 illustrates a schematic view of one embodiment of a control diagram for electronically controlling the operation of the motor of the disclosed waste disposal.

An example of a suitable control diagram that may be implemented for controlling the operation of the motor 124 is illustrated in FIG. 21. As shown, the controller 340 may be configured to generate various control signals (e.g., commanded speed signals 342, speed error signals 344, current command signals 346, duty signals 348 and/or the like) and transmit such signals to suitable components of the motor 124 in order to control its operation. For example, the controller 340 may be configured to output duty signals 348 to a gate driver 350, which may, in turn, transmit gating command signals 352 to an inverter 354 for alternating or switching the current phase supplied to the motor windings 202. In addition, the controller 340 may be configured to receive operational feedback (e.g., from sensors and/or the like) in order to appropriately adjust such control signals and/or to otherwise control the motor 124 in order to achieve the desired operation. For example, as shown in FIG. 21, the controller 340 may receive feedback related to the actual speed of the motor 124, the temperature of the motor 124, the occurrence of jams within the motor 124, the position of the rotor 178 and/or any other suitable feedback.

During operation of the disclosed disposal 102, a commanded speed signal 342 may be generated by the controller 340 for controlling the rotor speed of the motor 124. In several embodiments, the commanded rotor speed may be constant or varied over time. For instance, in one embodiment, the commanded rotor speed may correspond to a reduced rotor speed at start-up of the disposal 102, with the rotor speed being ramped up over time from the reduced start-up speed to a full operational speed. Such a reduced start-up speed may allow for reduced noise generation at start-up.

As shown in FIG. 21, the commanded speed signal 342 generated by the controller 340 may be input into a summer 356 that determines the difference between the commanded rotor speed and an actual rotor speed 358 for the motor 124, which is provided to the summer 356 by a speed calculation module 360 of the controller 340. The summer 356 provides a speed error signal 344 to a speed compensation module 362 of the controller 340 configured to determine the corresponding current command signal 346 required to achieve the commanded speed 342 based on the speed error signal 344. The current command signal 344 is then provided to a pulse-width modulation (PWM) module 364 of the controller 340 that generates a duty cycle signal 348 based on the current command signal 346. The duty cycle signal 348 may then be provided to the gate driver 350 to generate suitable gating command signals 352 for switching the switching elements (e.g., insulated-gate bipolar transistors (IGBTs) or metal-oxide-semiconductor field-effect transistors (MOSFETs)) of the associated inverter 354 in accordance with the commanded duty cycle 348. As is generally understood, the gating command signals 352 may configure the inverter 354 to convert a DC voltage source (not shown) to AC driving currents for powering the windings 202 of the motor 124, thereby allowing the rotor 178 to be rotated relative to the stator 176.

Additionally, as shown in FIG. 21, in several embodiments, the controller 340 may be configured to receive motor current feedback signals 366 (e.g., via a current sensor associated with the inverter 354). The current feedback signals 366 may then be transmitted to an analog-to-digital converter 368 in order to convert the analog signals to suitable digital signals than can be understood and processed by the controller 340. As shown in FIG. 21, in one embodiment, the current feedback signals 366 may be utilized by the controller 340 (e.g., via the speed calculation module 360) to determine the actual rotor speed 358 of the motor 124. Specifically, a suitable correlation (e.g., a mathematical relationship or look-up table) may be stored within the controller 340 that relates the motor current 366 to the actual rotor speed 258. As indicated above, this calculated rotor speed 358 may then be input into the summer 356 in order to generate the speed error signal 344. Alternatively, the controller 340 may be configured to determine the actual rotor speed 358 using any other suitable means. For instance, in one embodiment, one or more sensors associated with the motor 124 (e.g., Hall Effect sensors, speed sensors, position sensors etc.) may be configured to provide suitable measurement signals to the controller 340 (indicated by dashed line 370) in order to allow for the calculation of the actual rotor speed 358.

In addition to calculating the rotor speed, the current feedback signals 366 may also be utilized by the controller 340 determine one or more other operating parameters of the motor 124. For instance, as shown in FIG. 21, in one embodiment, the current feedback signals 366 may be provided to a temperature estimation module 372 that is configured to estimate the temperature of the motor 124 based on the motor current. In such an embodiment, if the estimated temperature exceeds a predetermined temperature threshold (or if the measured current value simply exceeds a predetermined current threshold), the controller 340 may be configured to shut-shown the motor 120 or take any other suitable corrective action in order to prevent overheating.

Additionally, as shown in FIG. 21, the current feedback signals 266 may also be provided to an anti jam module 374 of the controller 340 that is configured to determine whether the motor 124 is jammed or otherwise stalled based on the motor current. For instance, in several embodiments, the controller 340 may be configured to detect whether the motor 124 is jammed by detecting sudden spikes or changes in the motor current. If a detected change in the current indicates that the motor 124 is jammed (e.g., due to the detected change exceeding a current variation threshold), the controller 1340 may be configured to perform any suitable corrective action designed to un-jam the motor 124. For instance, the controller 340 may be configured to cycle the motor direction between forward and reverse in order to remove any obstructions that may be preventing or hindering rotation of the rotor 178.

Moreover, as shown in FIG. 21, the controller 340 may also be configured to receive any other suitable feedback signals, such as rotor position feedback signals 376 that may be used to commutate the motor 124. For instance, the rotor position feedback signals 376 may correspond to measurement signals derived from Hall Effect sensors, back emf sensors and/or any other suitable sensors that provide for an indication of the position of the rotor 178. These signals 376 may then be utilized by the controller 340 to determine the correct timing for switching the current phases supplied to the motor windings 202.

It should be appreciated that the control diagram shown in FIG. 21 is simply illustrated to provide one example of a suitable control methodology for controlling the disclosed motor 124. However, those of ordinary skill in the art should readily appreciate that the specific control methodology utilized to control the motor 124 may vary depending on, for example, the type and configuration of the motor 124, the specific feedback signals provided to the controller 340 and/or various other suitable factors.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A waste disposal for processing waste, the waste disposal comprising:

a housing defining an inner sidewall surface extending around an inner perimeter of the housing and a discharge outlet, the housing configured to receive waste discharged from a sink; and a motor disposed within the housing, the motor including a stator and a rotor at least partially surrounding the stator, the rotor including a sidewall defining an outer surface, the motor being disposed within the housing such that an annular gap is defined between the inner sidewall surface of the housing and the outer surface of the sidewall, wherein, when the rotor is rotated relative to the stator, water is drawn through the annular gap towards the discharge outlet.

2. The waste disposal of claim 1, wherein a width of the annular gap is selected such that a surface tension between the inner sidewall surface and the outer surface draws the water through the annular gap when the sidewall is rotated relative to the housing.

3. The waste disposal of claim 2, wherein the width ranges from about 0.5 millimeters to about 10 millimeters.

4. The waste disposal of claim 1, wherein the annular gap comprises a first annular gap, further comprising a cutter plate rotatably coupled to the motor for rotation therewith, the cutter plate being disposed relative to the housing such that a second annular gap is defined between the housing and a sidewall of the cutter plate.

5. The waste disposal of claim 4, wherein a width of the second annular gap differs from a width of the first annular gap.

6. The waste disposal of claim 1, wherein the rotor further comprises a bottom wall extending radially inwardly from the sidewall, the bottom wall defining a lower surface extending adjacent to a bottom surface of the housing such that a gap is defined between the lower surface and the bottom surface.

7. The waste disposal of claim 6, further comprising a plurality of ribs formed along the bottom wall of the rotor, the plurality of ribs being configured to push water contained within the gap radially outwardly along the bottom surface of the housing towards the discharge outlet when the rotor is rotated relative to the stator.

8. The waste disposal of claim 7, wherein the plurality of ribs extend radially along the lower surface of the bottom wall towards the sidewall of the rotor.

9. The waste disposal of claim 7, wherein the plurality of ribs project axially from the lower surface of the bottom wall such that each rib defines a height relative to the lower surface.

10. The waste disposal of claim 9, wherein the height of each rib corresponds to a distance ranging from about 30% of a height of the gap to about 95% of the height of the gap.

11. The waste disposal of claim 1, wherein the discharge outlet is oriented relative to the housing such that waste is discharged from the discharge outlet at a non-radial flow angle.

12. A waste disposal for processing waste, the waste disposal comprising:

a housing defining a bottom surface and a discharge outlet, the housing configured to receive waste discharged from a sink;

a motor disposed within the housing, the motor including a stator and a rotor at least partially surrounding the stator, the rotor including a sidewall and a bottom wall extending radially inwardly from the sidewall, the bottom wall defining a lower surface extending adjacent to the bottom surface of the housing such that a gap is defined between the lower surface and the bottom surface; and a plurality of ribs formed along the bottom wall of the rotor, the plurality of ribs being configured to push water contained within the gap radially outwardly along the bottom surface of the housing towards the discharge outlet when the rotor is rotated relative to the stator.

13. The waste disposal of claim 12, wherein the plurality of ribs extend radially along the lower surface of the bottom wall towards the sidewall of the rotor.

14. The waste disposal of claim 12, wherein the plurality of ribs project axially from the lower surface of the bottom wall such that each rib defines a height relative to the lower surface.

15. The waste disposal of claim 14, wherein the height of each rib corresponds to a distance ranging from about 30% of a height of the gap to about 95% of the height of the gap.

16. The waste disposal of claim 12, wherein the sidewall defines an outer surface and the housing defines an inner sidewall surface extending around an inner perimeter of the housing, the motor being disposed within the housing such that an annular gap is defined between the inner sidewall surface and the outer surface, wherein, when the rotor is rotated relative to the stator, water is drawn through the annular gap towards the discharge outlet.

17. The waste disposal of claim 16, wherein a width of the annular gap is selected such that a surface tension between the inner sidewall surface and the outer surface draws the water through the annular gap when the sidewall is rotated relative to the housing.

18. The waste disposal of claim 16, wherein the annular gap comprises a first annular gap, further comprising a cutter plate rotatably coupled to the motor for rotation therewith, the cutter plate being disposed relative to the housing such that a second annular gap is defined between the housing and a sidewall of the cutter plate.

19. The waste disposal of claim 18, wherein a width of the second annular gap differs from a width of the first annular gap.

20. The waste disposal of claim 1, wherein the discharge outlet is oriented relative to the housing such that waste is discharged from the discharge outlet at a non-radial flow angle.

* * * * *